US010539906B2

(12) United States Patent
Kawaguchi et al.

(10) Patent No.: US 10,539,906 B2
(45) Date of Patent: Jan. 21, 2020

(54) IMAGE FORMING APPARATUS TO ACQUIRE IMAGE BEARING MEMBER SURFACE POTENTIALS

(71) Applicant: CANON KABUSHIKI KAISHA, Tokyo (JP)

(72) Inventors: Yuji Kawaguchi, Inagi (JP); Kazuhiro Okubo, Kawasaki (JP); Takahiro Kawamoto, Yokohama (JP); Masanori Tanaka, Yokohama (JP); Jun Miura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/117,711

(22) Filed: Aug. 30, 2018

(65) Prior Publication Data

US 2019/0079429 A1 Mar. 14, 2019

(30) Foreign Application Priority Data

Sep. 8, 2017 (JP) ..... 2017-173471

(51) Int. Cl.

| | |
|---|---|
| ***G03G 15/00*** | (2006.01) |
| ***G03G 15/02*** | (2006.01) |
| ***G03G 15/043*** | (2006.01) |
| ***G03G 15/06*** | (2006.01) |
| ***G03G 15/16*** | (2006.01) |
| ***G03G 21/00*** | (2006.01) |
| ***G03G 15/08*** | (2006.01) |

(52) U.S. Cl.
CPC ..... *G03G 15/043* (2013.01); *G03G 15/0808* (2013.01); *G03G 15/0865* (2013.01); *G03G 15/80* (2013.01)

(58) Field of Classification Search
CPC ..... G03G 15/043; G03G 15/065; G03G 15/5037; G03G 15/0266; G03G 15/1645; G03G 15/1675; G03G 21/0023
USPC ..... 399/48, 50, 51, 55, 66, 71
See application file for complete search history.

(56) References Cited

U.S. PATENT DOCUMENTS 10,151,994 B2 * 12/2018 Mori et al. ..... G03G 15/0266

FOREIGN PATENT DOCUMENTS

JP 2010113103 A 5/2010

* cited by examiner

*Primary Examiner* — William J Royer
(74) *Attorney, Agent, or Firm* — Canon USA, Inc., IP Division

(57) ABSTRACT

In an image forming apparatus, a control unit performs a control to cause an exposing unit to expose a plurality of image bearing members at different times to form exposure regions on the plurality of image bearing members, to acquire results acquired by applying direct current voltage lower than discharge start voltage to a plurality of abutting members by an applying unit when the exposure regions pass by abutting parts against the abutting members and detected by a detecting unit, and to, based on the acquired results of the detections, acquire information regarding the surface potentials of the plurality of image bearing members.

20 Claims, 15 Drawing Sheets

IMAGE FORMING APPARATUS TO ACQUIRE IMAGE BEARING MEMBER SURFACE POTENTIALS

BACKGROUND

Field of the Disclosure

The present disclosure generally relates to image forming and, more particularly, to an image forming apparatus such as an electrophotographic copier, printer, facsimile apparatuses, or the like.

Description of the Related Art

An electrophotographic image forming apparatus in the past performs an operation for charging an image bearing member such as a photosensitive member and an electrostatic recording dielectric substance by discharging. Technologies such as corona electrical charging and contact electrification have been known for charging an image bearing member by discharging. In particular, contact electrification has often been adopted in recent years because of its advantages of low ozone generation and low power consumption. According to the contact electrification, voltage equal to or greater than discharge start voltage is applied to a charging member in contact with an image bearing member so that a surface of the image bearing member can be charged by discharging occurring in a minute void between the image bearing member and the charging member. As the charging member, a charging roller that is a roller-shaped member has been used widely from a viewpoint of high charge stability.

Such a scheme which charges an image bearing member by discharging may generate a discharge product such as ozone and NOx, and the discharge product attaches to a surface of the image bearing member. The contact electrification produces a lower amount of discharging and generates a less discharge product, compared with corona electrical charging using a corona charger. However, because, according to the contact electrification, a discharge product occurs at a minute void between an image bearing member and a charging member, the discharge product attaches to a surface of the image bearing member even if the occurring discharge product is less. When a discharge product is attached to a surface of the image bearing member, the discharge product absorbs moisture and reduces resistance of the surface of the image bearing member, which thus reduces the charge holding capacity of the image bearing member. This may cause a phenomenon called "image smearing" resulting in a defective electrostatic latent image by missing, blurring and smearing.

In order to reduce such an influence of the discharge product, methods have been known which will be described below. For example, a heater placed inside or neighboring to an image bearing member may be used to increase the temperature of a surface of the image bearing member and thus to dry the surface of the image bearing member. Alternatively, an image bearing member may be rotated during a non-image-forming period to increase the number of times of friction per unit time period between the image bearing member and a cleaning member to remove the discharge product. Further alternatively, abrasives may be supplied to a surface of the image bearing member for improved polishing capability of the image bearing member with a cleaning member. Further alternatively, a release agent for improved releasability may be supplied to a surface of an image bearing member to prevent a discharge product from easily attaching to the surface of the image bearing member.

Operations for reduction of such influences of a discharge product may be desirably executed in a state that image smearing easily occurs for suppression of consumption of energy and materials more than necessary, wearing of components, and reduction of image productivity. Image smearing may easily occur when, for example, an image forming apparatus is installed in a high temperature with high humidity environment that is harsh for printing operations over a long period of time. Accordingly, a technology has been proposed which detects a state where image smearing may easily occur and executes operations for reducing influences of a discharge product as described above.

Japanese Patent Laid-Open No. 2010-113103 proposes a method for detecting a state that image smearing may easily occur based on a fact that an image bearing member is slightly charged in a case where direct current voltage lower than discharge start voltage is applied to a charging member when a discharge product is attached to a surface of the image bearing member. This method can be implemented by providing a detection circuit configured to detect an electric current value or a voltage value when direct current voltage lower than discharge start voltage is applied to a charging member, without requiring a potential sensor configured to detect a surface potential of the image bearing member around the image bearing member, which can advantageously reduce the size and costs of an apparatus to be applied.

Here, the detection method in the past if adopted is desirably implemented by using a minimum necessary detection circuit from viewpoints of reduction of the size and costs of an apparatus to be applied. However, in a case where the conventional detection method is applied to a tandem type image forming apparatus having a plurality of image bearing members and where the plurality of image bearing members share such a detection circuit, it may be difficult to distinguish each of the image bearing members and to detect which of them has a state that image smearing may easily occur. Japanese Patent Laid-Open No. 2010-113103 does not give any suggestion with respect to the point.

SUMMARY

Accordingly, the present disclosure provides an image forming apparatus which can identify each of a plurality of image bearing members and detect whether each of them has a state that image smearing may easily occur or not.

According to one or more aspects of the disclosure, an image forming apparatus includes a plurality of rotatable image bearing members; a plurality of abutting members abutting against the corresponding plurality of image bearing members to form an abutting part, an applying unit configured to apply voltage to the plurality of abutting members, an exposing unit configured to expose the plurality of image bearing members to light, a common detecting unit configured to detect a value of electric current flowing or voltage generated when the applying unit applies voltage to the plurality of abutting members, and a control unit configured to perform a control to cause the exposing unit to expose the plurality of image bearing members at different times to form exposure regions on surfaces of the plurality of image bearing members and to acquire information regarding surface potentials of the plurality of image bearing members based on results acquired by applying direct current voltage lower than discharge start voltage to the plurality of abutting members by the applying unit when the exposure regions passes by the abutting parts and detected by the detecting unit.

Further features of the present disclosure will become apparent from the following description of exemplary embodiments with reference to the attached drawings.

DESCRIPTION OF THE EMBODIMENTS

Various exemplary embodiments, features, and aspects of the present disclosure will be described in more detail below with reference to drawings.

Embodiment 1

1. Overall Configuration and Operations of Image Forming Apparatus

Figure 1:
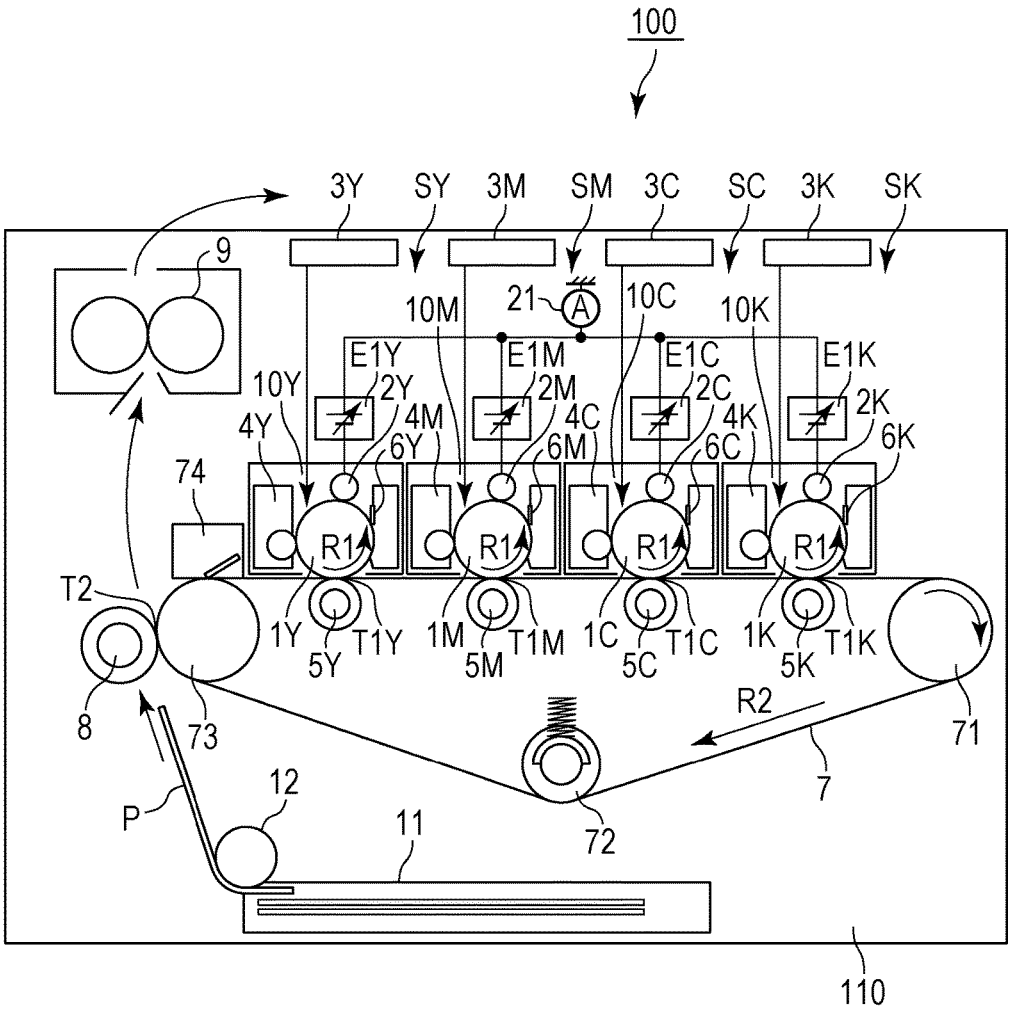
FIG. 1 is a schematic cross-sectional view illustrating an image forming apparatus according to Embodiment 1.

FIG. 1 is a schematic cross-sectional view of an image forming apparatus 100 according to Embodiment 1. The image forming apparatus 100 according to this embodiment is an intermediate transfer, tandem type, inline laser beam printer based on electrophotography to form a full-color image.

Figure 2:
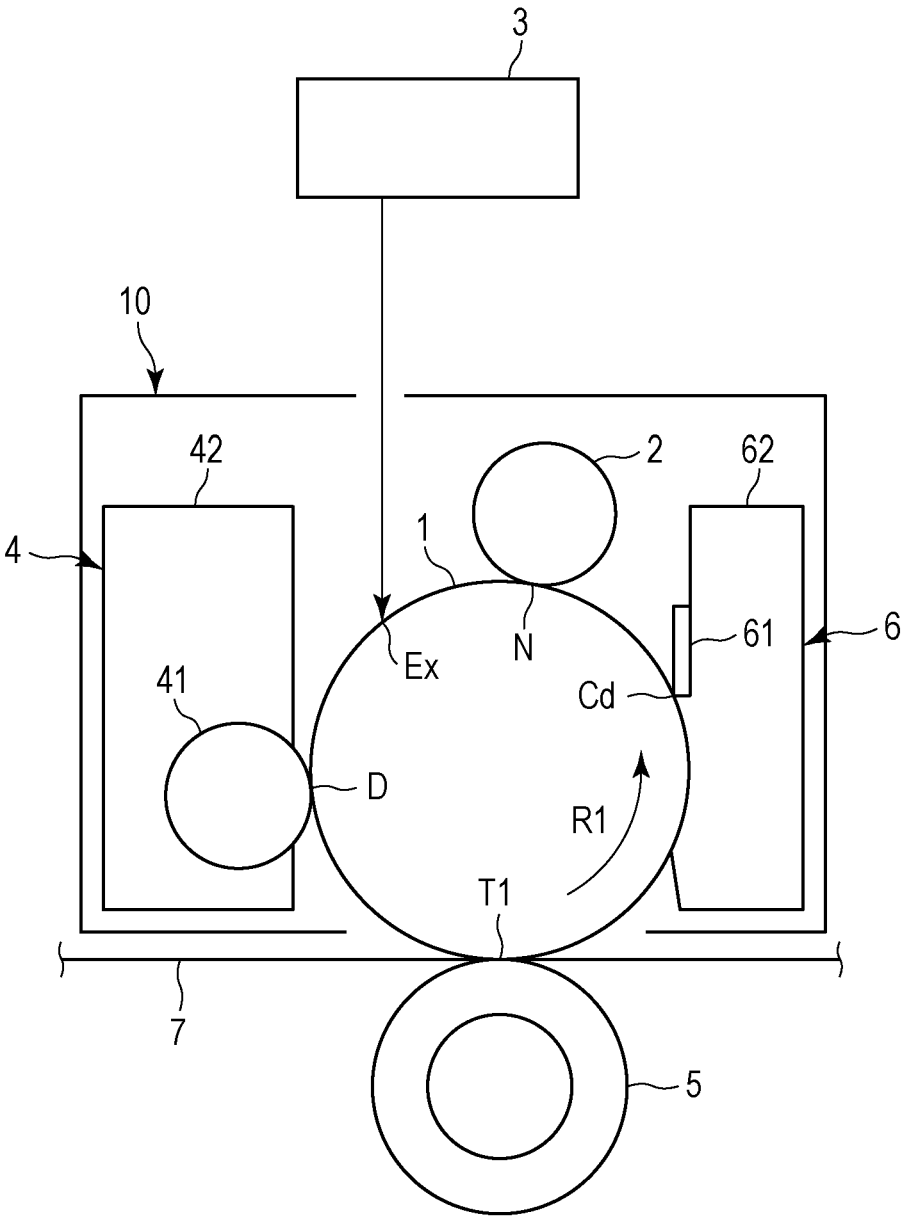
FIG. 2 is a schematic cross-sectional view illustrating an image forming unit according to Embodiment 1.

The image forming apparatus 100 has first, second, third, and fourth image forming units SY, SM, SC, and SK configured to form images of colors of yellow, magenta, cyan, and black, respectively, in a station including a plurality of image forming units. Elements having identical or corresponding functions or configurations in the image forming units SY, SM, SC, and SK may be collectively indicated references without Y, M, C, and K at their ends. FIG. 2 is a schematic cross-sectional view of an image forming unit S. According to this embodiment, the image forming unit S has a photoconductive drum 1, a charging roller 2, an image exposure device 3, a developing device 4, a primary transfer roller 5, and a drum cleaning device 6.

The image forming apparatus 100 has the photoconductive drum 1 that is a cylindrical, drum-shaped photosensitive member functioning as an image bearing member. According to this embodiment, the photoconductive drum 1 is formed by sequentially stacking a primary coat, a charge generating layer, and a charge transport layer on an aluminum tube stock. According to this embodiment, the primary coat, the charge generating layer and the charge transport layer configure a photoconductive layer. The photoconductive drum 1 is driven to rotate at a process speed that is a predetermined circumferential velocity in a clockwise direction R1 indicated by an arrow illustrated in FIG. 1 by a drum driver 13 (FIG. 3) in a drive unit. According to this embodiment, the circumferential velocity of the photoconductive drum 1 is equal to approximately 150 mm/sec.

A surface of the rotating photoconductive drum 1 is uniformly charged with a predetermined potential of a negative polarity that is a predetermined polarity by a charging roller 2 that is a roller-shaped charging member functioning as a charging device. According to this embodiment, the charging roller 2 has a core metal and a conductive elastic layer coaxially integrated around the core metal and is arranged such that the rotation axial direction of the charging roller 2 can be substantially parallel to the rotation axial direction of the photoconductive drum 1. The charging roller 2 is in contact and is abutted against the photoconductive drum 1 with a predetermined pressing force against the elasticity of the conductive elastic layer. The core metal of the charging roller 2 has both ends rotatably supported by a bearing member so that the charging roller 2 can rotate in association with the rotation of the photoconductive drum 1. The charging roller 2 is an example of an abutting member that is to be abutted against the photoconductive drum 1. During a charging process, charging voltage is applied to the charging roller 2 through the core metal from a charging power supply E1 that is an application unit where the charging voltage is direct current voltage having a negative polarity being a predetermined polarity. According to this embodiment, the charging voltage is approximately 1200 V direct current voltage. Thus, the surface of the photoconductive drum 1 is charged with a −650 V charge potential.

The charged surface of the photoconductive drum 1 undergoes scanning exposure based on image information by the image exposure device 3 functioning as an exposing unit so that an electrostatic latent image can be formed on the photoconductive drum 1. According to this embodiment, the image exposure device 3 may be a laser scanner device. The image exposure device 3 receives time-series electrical digital pixel signals generated when a control unit 50 (FIG. 3) processes the image information. The image exposure device 3 has a laser output unit configured to output laser light modulated correspondingly to the time-series electrical digital pixel signals, a polygon mirror being a rotatable polygonal mirror, an fθ lens, and reflecting mirror. The image exposure device 3 scans in a main-scanning direction substantially parallel to a rotation axial direction of the photoconductive drum 1 while applying laser light to the surface of the photoconductive drum 1. The laser light is also scanned in a sub-scanning direction substantially parallel to the movement direction of the surface of the photoconductive drum 1 because of the rotation of the photoconductive drum 1. Thus, an electrostatic latent image corresponding to the image information is formed on the photoconductive drum 1.

The electrostatic latent image formed on the photoconductive drum 1 is developed with toner being a developer by the developing device 4 being a developing device for visualization so that the resulting toner image can be formed on the photoconductive drum 1. According to this embodiment, the developing device 4 applies a contact developing method. The developing device 4 has a developing member development roller 41 being a developer bearing member as a development member and a developer container 42 configured to accommodate toner. The developer container 42 accommodates non-magnetic toner being a nonmagnetic one-component developer as a developer. The development roller 41 bears toner accommodated in the developer container 42 and conveys it to a region facing the photoconductive drum 1. According to this embodiment, the development roller 41 has a core metal and a conductive elastic layer coaxially integrated around the core metal such that the rotation axial direction of the development roller 41 can be substantially parallel to the rotation axial direction of the photoconductive drum 1. The development roller 41 bears toner charged to have a negative polarity due to friction and conveys it to the region facing the photoconductive drum 1. The development roller 41 which bears toner is abutted against the photoconductive drum 1 and attaches the toner based on the electrostatic latent image formed on the photoconductive drum 1 to the surface of the photoconductive drum 1. During a development process, the development roller 41 receives development voltage being direct current voltage having a negative polarity that is a predetermined polarity, from a development power supply E2 (FIG. 3) through the core metal. According to this embodiment, the development voltage is approximately −400 V direct current voltage. According to this embodiment, a reversal development scheme is applied which transfers toner charged to have a negative polarity that is the same polarity as the charge polarity of the photoconductive drum 1 to an exposed region on the photoconductive drum 1 having a potential with a reduced absolute value as a result of the exposure after the uniformly charged. According to this embodiment, a normal charge polarity of the toner that is a charge polarity of the toner for developing is a negative polarity. The development roller 41 and the photoconductive drum 1 can be switched between a contact state and a separated state through a development contact and separation mechanism 15 (FIG. 3) that is a contact and separation unit. The development roller 41 may be substantially abutted against the photoconductive drum 1 only for developing operations.

An intermediate transfer belt 7 is arranged to face the entire photoconductive drum 1. The intermediate transfer belt 7 is an endless belt configured as an intermediate transfer member. According to this embodiment, the intermediate transfer belt 7 is an endless belt of a resin film having a volume resistivity of approximately $10^{11}$ to $10^{16}$ Ω·cm as a resistance value and having a thickness of approximately 100 to 200 μm. The intermediate transfer belt 7 may contain PVdf (polyvinylidene difluoride), nylon, PET (polyethylene terephthalate), PC (polycarbonate) or the like. The intermediate transfer belt 7 is put across a driving roller 71, a tension roller 72 and a secondary transfer facing roller 73, which are a plurality of supporting and stretching rollers and is stretched with a predetermined tensile force. In the intermediate transfer belt 7, the driving roller 71 is driven to rotate by a belt driver 14 (FIG. 3) functioning as a drive unit so that the driving roller 71 rotates at a circumferential velocity that is substantially equal to the circumferential velocity of the photoconductive drum 1 in a counterclockwise direction R2 indicated by an arrow in FIG. 1 for a circulating movement. The primary transfer roller 5 that is a roller-shaped primary transfer member functioning as a primary transfer device is provided on an inner peripheral surface side of the intermediate transfer belt 7 correspondingly to the photoconductive drums 1. According to this embodiment, the primary transfer roller 5 has a core metal and a conductive elastic layer coaxially integrated around the core metal and is arranged such that the rotation axial direction of the charging roller 2 can be substantially parallel to the rotation axial direction of the photoconductive drum 1. The primary transfer roller 5 is urged toward the photoconductive drum 1 through the intermediate transfer belt 7 to press the intermediate transfer belt 7 toward the photoconductive drum 1 so that a primary transfer part T1 can be formed in which the photoconductive drum 1 and the intermediate transfer belt 7 are in contact. In other words, the primary transfer roller 5 is abutted with a predetermined pressing force against the photoconductive drum 1 through the intermediate transfer belt 7. The primary transfer roller 5 rotates in association with rotation of the intermediate transfer belt 7. The primary transfer roller 5 and the photoconductive drum 1 can be switched between a contact state and a separated state through a primary transfer contact and separation mechanism 16 (FIG. 3) that is a primary transfer contact and separation unit. When the primary transfer roller 5 is separated from the photoconductive drum 1, the intermediate transfer belt 7 is separated from the photoconductive drum 1.

The toner image formed on the photoconductive drum 1 as described above undergoes primary transfer onto the intermediate transfer belt 7 functioning as a rotating transfer material in the primary transfer part T1 because of the action of the primary transfer roller 5. During a primary transferring process, the primary transfer roller 5 receives primary transfer voltage that is direct current voltage having a positive polarity opposite to the normal charge polarity of the toner from a primary transfer power supply E3 (FIG. 3) through the core metal. Thus, a primary transfer electric field is formed in the primary transfer part T1. For example, in order to form a full-color image, toner images of colors of yellow, magenta, cyan, and black formed on the photoconductive drums 1Y, 1M, 1C, and 1K are sequentially primary transferred one upon another on the intermediate transfer belt 7.

Figure 3:
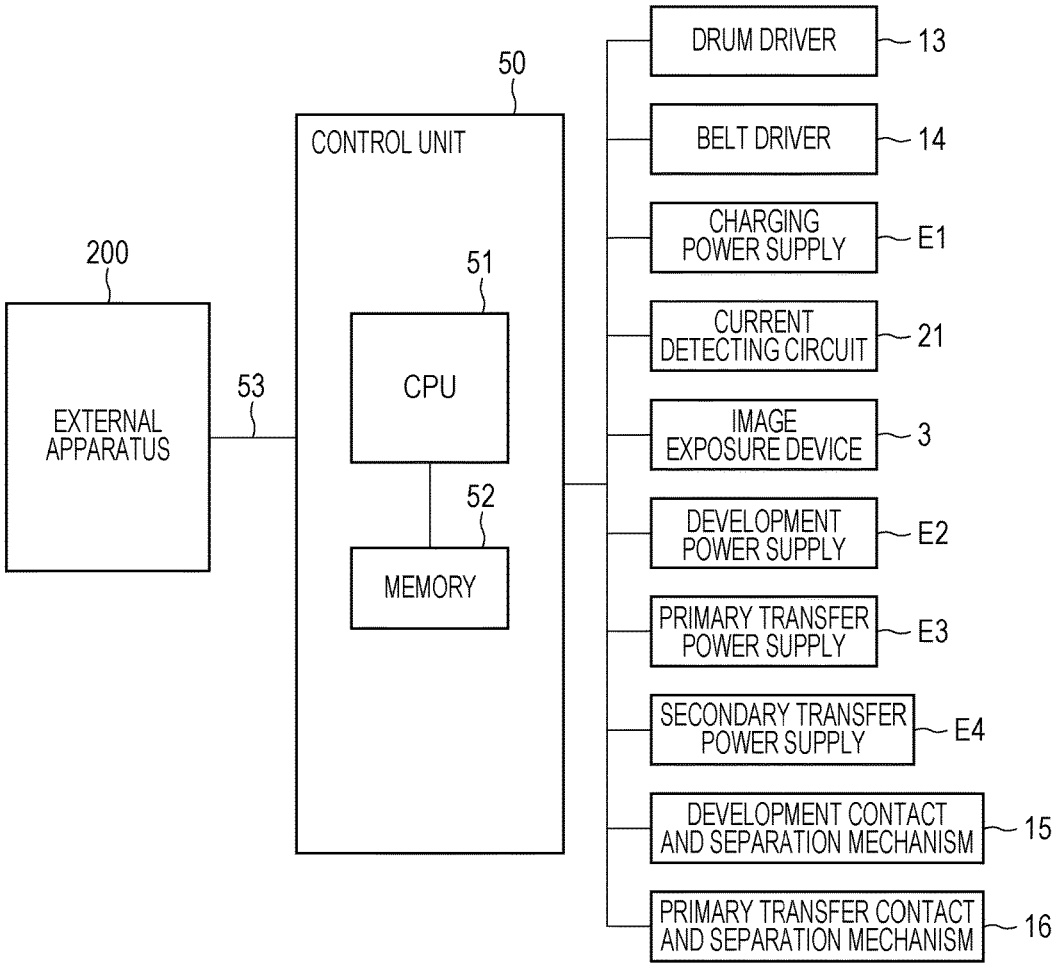
FIG. 3 is a schematic block diagram illustrating a control configuration of a main part of the image forming apparatus according to Embodiment 1.

On an outer peripheral surface side of the intermediate transfer belt 7, a secondary transfer roller 8 is placed at a position facing the secondary transfer facing roller 73. The secondary transfer roller 8 is a roller-shaped secondary transfer member being a secondary transfer device. The secondary transfer roller 8 is pressed toward the secondary transfer facing roller 73 through the intermediate transfer belt 7 so that a secondary transfer part T2 can be formed in which the intermediate transfer belt 7 and the secondary transfer roller 8 are in contact. The toner image formed on the intermediate transfer belt 7 as described above undergoes secondary transfer onto a recording material P pinched and conveyed by the intermediate transfer belt 7 and the secondary transfer roller 8 because of an action of the secondary transfer roller 8 in the secondary transfer part T2. The recording material P may be recording paper, an OHP sheet, a postcard, an envelope, a label or the like. During the secondary transferring process, the secondary transfer roller 8 receives secondary transfer voltage that is direct current voltage having a positive polarity opposite to the normal charge polarity of the toner from a secondary transfer power supply E4 (FIG. 3). Thus, a secondary transfer electric field is formed in the secondary transfer part T2.

The recording material P may be conveyed from a cassette 11 functioning as a storage unit to a feeding roller 12 functioning as a conveyance member and is supplied to the secondary transfer part T2 in synchronization with the toner image on the intermediate transfer belt 7. The recording material P having the toner image transferred is heated and pressurized by a fixing device 9 functioning as a fixing unit so that the toner image having undergone melt solidification through the fixing is externally discharged to an apparatus main body 110 of the image forming apparatus 100.

On the other hand, primary residual toner remaining on the surface of the photoconductive drum 1 without being transferred to the intermediate transfer belt 7 during the primary transfer process is removed and is collected from the surface of the photoconductive drum 1 by the drum cleaning device 6 functioning as a photosensitive member cleaning device. The drum cleaning device 6 has a cleaning blade 61 and a cleaner case 62. The cleaning blade 61 functions as a cleaning member abutted against the surface of the photoconductive drum 1. According to this embodiment, the cleaning blade 61 may be an elastic cleaning blade having a chip blade of urethane rubber and a sheet metal supporting the cleaning blade. The cleaning blade 61 is abutted against the surface of the photoconductive drum 1 in the counter direction with its free end directing toward the upstream side of the rotation direction of the photoconductive drum 1. The drum cleaning device 6 then scrapes off the primary residual toner from the surface of the rotating photoconductive drum 1 by using the cleaning blade 61 and accommodates the toner within the cleaner case 62. A belt cleaning device 74 functioning as a cleaning device for the intermediate transfer member is placed at a position facing the secondary transfer facing roller 73 on an outer peripheral surface of the intermediate transfer belt 7. During the secondary transfer process, secondary residual toner remaining on the surface of the intermediate transfer belt 7 without being transferred to the recording material P is removed and is collected from the surface of the intermediate transfer belt 7 by the belt cleaning device 74.

According to this embodiment, in each of the image forming units S, the photoconductive drum 1, the charging roller 2 functioning as a processing unit configured to act thereon, the developing device 4, and the drum cleaning device 6 are integrated in a process cartridge 10 that is detachably attached to the apparatus main body 110. When the developing device 4 is out of toner or when the photoconductive drum 1 reaches its lifetime, for example, the process cartridge 10 is replaced by a new one.

Here, the charging position is a position where a charging process is performed by the charging roller 2 in the rotation direction of the photoconductive drum 1 that is the movement direction of the surface of the photoconductive drum 1. The charging roller 2 performs the charging process on the photoconductive drum 1 by discharging occurring at least one of minute voids between the charging roller 2 and the photoconductive drum 1 upstream and downstream of a charge nip N where the charging roller 2 and the photoconductive drum 1 are abutted against each other in the rotation direction of the photoconductive drum 1. For simplicity, however, it may be fictitiously considered that the abutting part between the charging roller 2 and the photoconductive drum 1 is the charging position. An image exposure position Ex is a position where exposure is performed by the image exposure device 3 in the rotation direction of the photoconductive drum 1. A developing position D corresponding to the abutting part of the development roller 41 and the photoconductive drum 1 where toner is supplied from the development roller 41 to the photoconductive drum 1 in the rotation direction of the photoconductive drum 1. The primary transfer part T1 is a contact position of the photoconductive drum 1 and the intermediate transfer belt 7 where a toner image is transferred from the photoconductive drum 1 to the intermediate transfer belt 7 in the rotation direction of the photoconductive drum 1. A cleaning position Cd is an abutting part of the cleaning blade 61 and the photoconductive drum 1 in the rotation direction of the photoconductive drum 1.

2. Control Mode

FIG. 3 is a schematic block diagram illustrating a control configuration of a main part of the image forming apparatus 100 according to this embodiment. The apparatus main body 110 of the image forming apparatus 100 includes a control unit 50 that is a control circuit. The control unit 50 has a central processing unit (CPU) 51 functioning as a processing control unit and a memory 52 functioning as a storing unit including a read only memory (ROM) and a random access memory (RAM). The CPU 51, which may include one or more processors and one or more memories, is configured to generally control operations to be performed by components of the image forming apparatus 100 based on programs stored in the memory 52. The control unit 50 connects to the drum driver 13, the belt driver 14, the power supplies E1 to E4, the image exposure device 3, the development contact and separation mechanism 15, and the primary transfer contact and separation mechanism 16. A current detecting circuit 21 functioning as an electric current detecting unit is connected to the control unit 50. The current detecting circuit 21 is configured to detect a value of an electric current fed to the charging roller 2 when voltage is applied from the charging power supply E1 to the charging roller 2. According to this embodiment, the current detecting circuit 21 is directly connected to the charging power supply E1. According to this embodiment, the charging power supply E1, the development power supply E2, and the primary transfer power supply E3 are independently provided for each of the image forming units SY, SM, SC, and SK, though not illustrated in FIG. 3. On the other hand, the current detecting circuit 21 is shared by all of the image forming units SY, SM, SC, and SK. According to this embodiment, the drum driver 13 can independently rotate/stop each of the photoconductive drums 1.

An external apparatus 200 is connected to the control unit 50 via an interface 53. The control unit 50 exchanges an electrical information signal with the external apparatus 200. The control unit 50 is further configured to process an electrical information signal input from a processing device or a sensor within the image forming apparatus 100 and to process a command signal to a processing device. The external apparatus 200 may be a host computer, a network, an image reader, a facsimile or the like, for example. The control unit 50 controls operations to be performed by the image forming apparatus 100 to form and output, on a recording material P, an image corresponding to image data that is electrical image information input from the external apparatus 200. The control unit 50 is further configured to control an image smearing detection operation and an image smearing suppression operation, which will be described below.

The units described throughout the present disclosure are exemplary and/or preferable modules for implementing processes described in the present disclosure. The term "unit", as used herein, may generally refer to firmware, software, hardware, or other component, such as circuitry or the like, or any combination thereof, that is used to effectuate a purpose. The modules can be hardware units (such as circuitry, firmware, a field programmable gate array, a digital signal processor, an application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure. Here, the image forming apparatus 100 is configured to execute a series of printing operations that is a job for forming and outputting an image on a single or a plurality of recording materials P, which is started in response to one start instruction. The job generally has an image forming process, a pre-rotation process, a sheet interval process if an image is to be formed on a plurality of recording material P, and a post-rotation process. The image forming process is performed during an image forming period for forming an electrostatic latent image of an image to be actually formed and output on a recording material P, forming a toner image, performing primary transfer and secondary transfer of the toner image. More specifically, the processes for forming an electrostatic latent image, forming a toner image, forming primary transfer and secondary transfer of the toner image are performed at one position but at different times. The pre-rotation process operates a preparation operation prior to an image forming process during a period from input of a start instruction to actual start of image formation. A sheet interval process corresponds to a period between recording materials P in a continuous image forming operation mode for continuously performing image forming on a plurality of recording materials P. A post-rotation process performs a preparation operation that is an organization operation after the image forming process. A non-image-forming period is performed during a period without image forming and may include the pre-rotation process, the sheet interval process, the post-rotation process, and a multiple pre-rotation process that is a preparation operation to be performed upon power supply to the image forming apparatus 100 or upon return from a sleep state thereof. According to this embodiment, during a non-image-forming period, an image smearing detection operation and an image smearing suppression operation, details of which will be described below, will be executed.

3. Image Smearing

Next, image smearing will be described. The following descriptions assume that magnitude relationships between voltage values, electric current values, and potentials refer to magnitude relationships between absolute values thereof for convenience.

Figure 4:
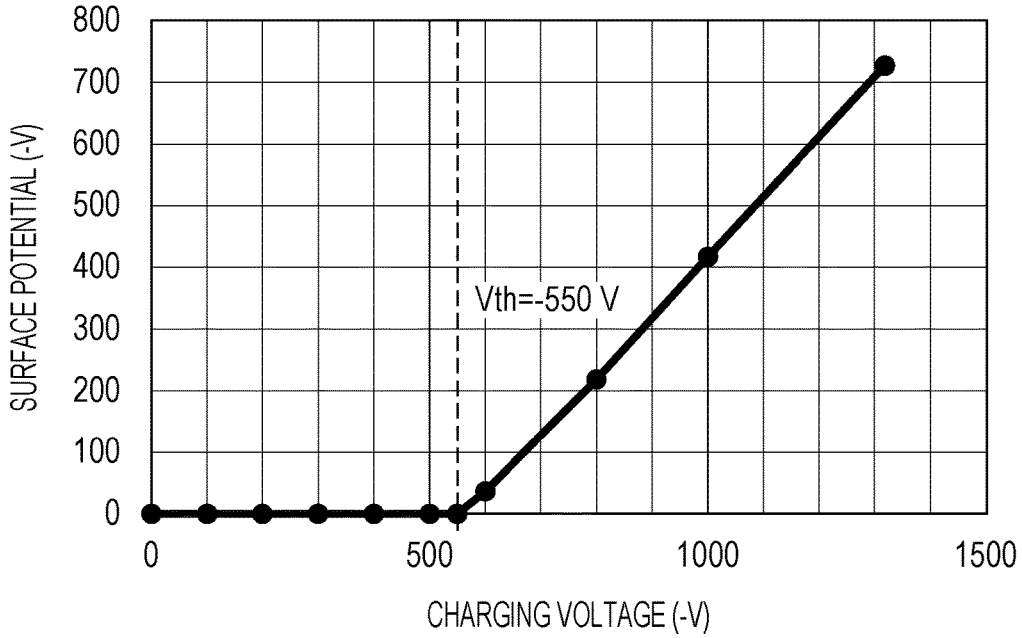
FIG. 4 is a graph illustrating a relationship between charging voltage and surface potentials of a photoconductive drum without image smearing according to Embodiment 1.

FIG. 4 is a graph illustrating results of measurements of a relationship between direct current voltage applied to the charging roller 2 and surface potentials of the photoconductive drum 1 in a high temperature/high humidity environment (hereinafter, called an H/H environment) at a temperature of 30° C. and a relative humidity of 80%. Referring to FIG. 4, measurement results are illustrated in a case where the photoconductive drum 1 without image smearing is used. As the direct current voltage applied to the charging roller 2 increases, the surface potential of the photoconductive drum 1 starts increasing from a certain voltage value though the surface potential of the photoconductive drum 1 does not rise up until the direct current voltage applied to the charging roller 2 is equal to or greater than the certain voltage value. The value of the direct current voltage with which the surface potential of the photoconductive drum 1 starts increasing is referred to as a discharge start voltage Vth. According to this embodiment, the discharge start voltage Vth may be −550 V, as an example. The discharge start voltage Vth depends on a void between the charging roller 2 and the photoconductive drum 1, the thickness, of the photoconductive layer of the photoconductive drum 1 and the relative permittivity of the photoconductive layer of the photoconductive drum 1. When a direct current voltage equal to or greater than the discharge start voltage Vth is applied to the charging roller 2, a discharge phenomenon occurs in the void between the charging roller 2 and the photoconductive drum 1 based on Paschen's law. Then, the surface of the photoconductive drum 1 is charged so that potentials are formed. In other words, when direct current voltage equal to or greater than the discharge start voltage Vth is applied to the charging roller 2, the surface potentials of the photoconductive drum 1 starts increasing. After that, the surface potentials of the photoconductive drum 1 increases based on a linear relationship with a substantial slope of 1 against the direct current voltage applied to the charging roller 2. Therefore, in order to acquire surface potentials (charge potentials) Vd of the photoconductive drum 1 for acquiring an electrophotograph, direct current voltage Vd +Vth is to be applied to the charging roller 2. When direct current voltage Vd +Vth is applied to the charging roller 2, discharging occurs between the photoconductive drum 1 and the charging roller 2 so that a potential corresponding to the direct current voltage Vd is formed on the surface of the photoconductive drum 1.

Figure 5:
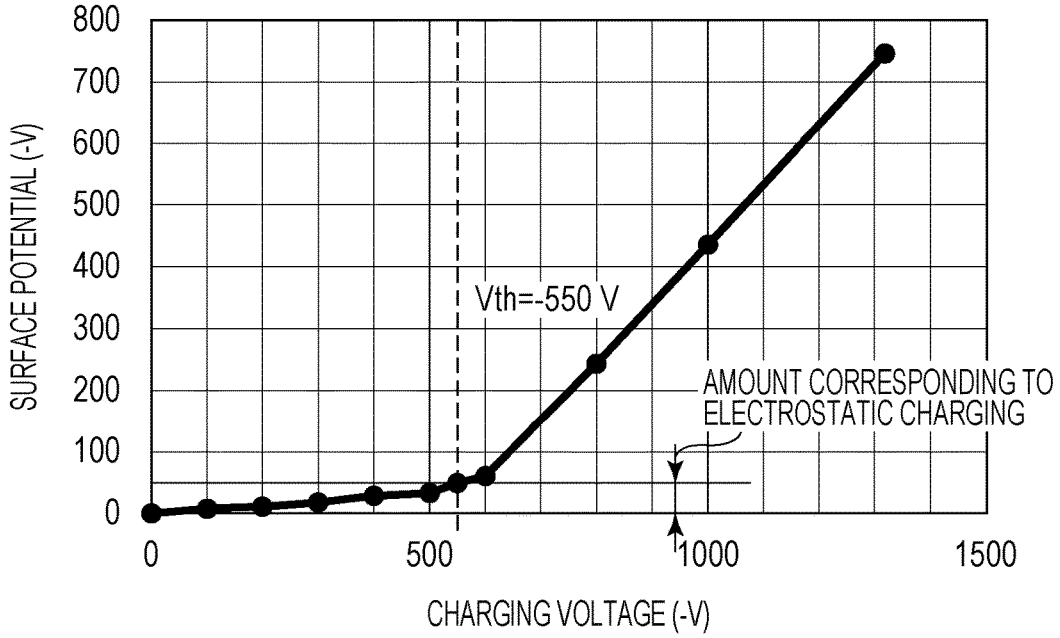
FIG. 5 is a graph illustrating a relationship between charging voltage and surface potentials of the photoconductive drum with image smearing according to Embodiment 1.

FIG. 5 is a graph illustrating results of measurements in an H/H environment with respect to a relationship between direct current voltage applied to the charging roller 2 and the surface potential of the photoconductive drum 1 in a case where the photoconductive drum 1 is used with which image smearing occurs. A discharge product attached to the surface of the photoconductive drum 1 absorbs moisture in a high humidity environment so that the resistance of the surface of the photoconductive drum 1 decreases and image smearing occurs. Referring to FIG. 5, the photoconductive drum 1 with image smearing has a surface potential starts increasing also when the direct current voltage applied to the charging roller 2 is lower than the discharge start voltage Vth. The discharge start voltage Vth is applied to the charging roller 2.

Then, the surface potential of the photoconductive drum 1 is equal to approximately −50 V. This is because the reduction of resistance on the surface of the photoconductive drum 1 with image smearing occurrence causes implanted charging and therefore the surface of the photoconductive drum 1 may have minute potentials even when direct current voltage lower than the discharge start voltage Vth is applied thereto based on Paschen's law.

Figure 6:
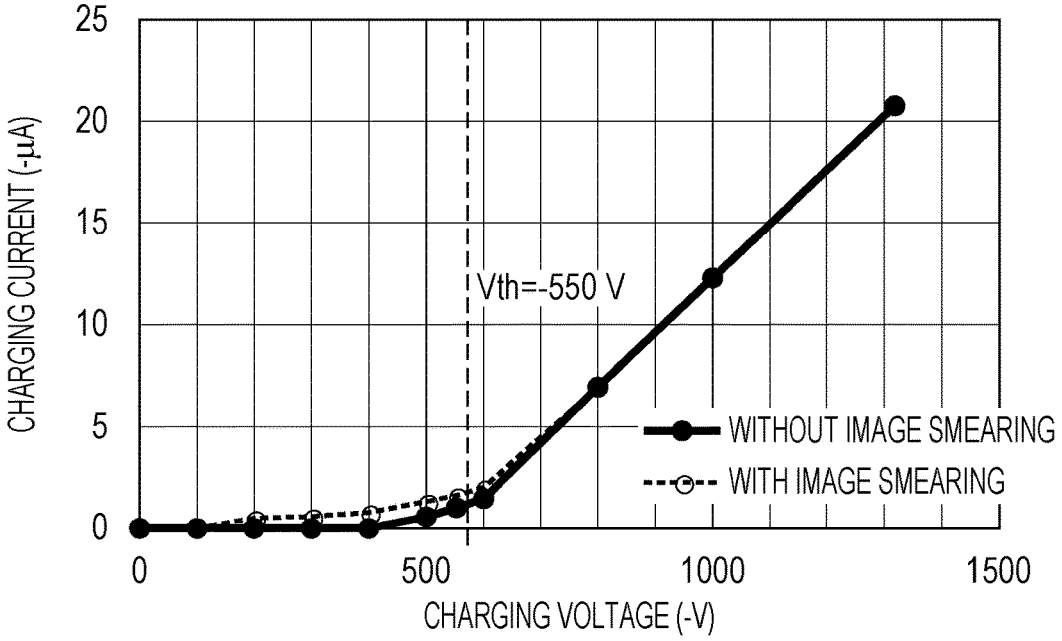
FIG. 6 is a graph illustrating a relationship between charging voltage and electric current value fed to a charging roller in a photoconductive drum without image smearing and a photoconductive drum with image smearing according to Embodiment 1.

FIG. 6 is a graph illustrating results of measurements in an H/H environment with respect to a relationship between direct current voltage applied to the charging roller 2 and electric current values detected by the current detecting circuit 21 by using the photoconductive drum 1 without image smearing and the photoconductive drum 1 with image smearing. In the photoconductive drum 1 without image smearing, if the direct current voltage applied to the charging roller 2 is lower than the discharge start voltage Vth, the current detecting circuit 21 does not detect electric current very much. On the other hand, in the photoconductive drum 1 with image smearing, if the direct current voltage applied to the charging roller 2 is lower than the discharge start voltage Vth, the current detecting circuit 21 detects electric current. This is because minute electric current is fed when a potential is formed on the surface of the photoconductive drum 1 due to implanted charging in the photoconductive drum 1 with image smearing.

Figure 7A:
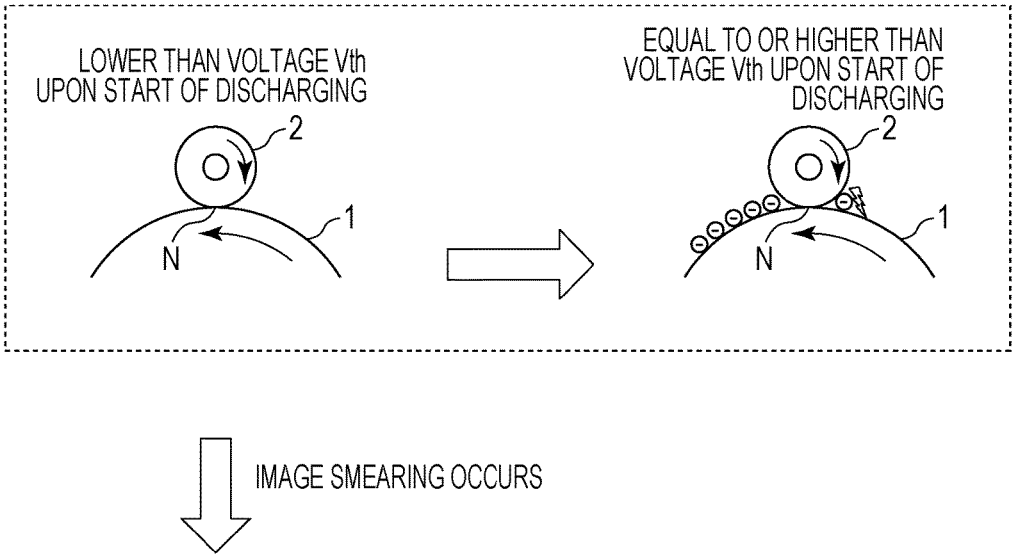
FIGS. 7A and 7B are schematic diagrams for explaining a mechanism with different detection results of electric current values between the photoconductive drum without image smearing and the photoconductive drum with the image smearing according to Embodiment 1.
Figure 7B:
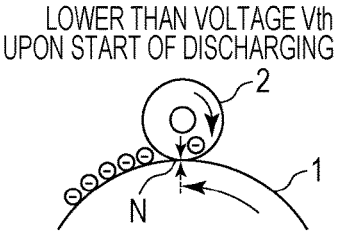

FIGS. 7A and 7B are schematic diagrams for explaining a mechanism for different detection results of electric current as described above. FIG. 7A illustrates a case where the photoconductive drum 1 without image smearing is used, and FIG. 7B illustrates a case where the photoconductive drum 1 with image smearing is used. As illustrated in FIG. 7A, in the photoconductive drum 1 without image smearing, if direct current voltage applied to the charging roller 2 is lower than the discharge start voltage Vth, as illustrated in the left part of FIG. 7A, no potential is formed on the surface of the photoconductive drum 1. If direct current voltage equal to or greater than the discharge start voltage Vth is applied to the charging roller 2, as indicated in the right part of FIG. 7A, discharging starts at a minute void between the charging roller 2 and the photoconductive drum 1 so that potentials are formed on the surface of the photoconductive drum 1. On the other hand, referring to FIG. 7B, in the photoconductive drum 1 with image smearing, if the direct current voltage applied to the charging roller 2 is lower than the discharge start voltage Vth, potentials are formed on the photoconductive drum 1. This is because moisture reacted and absorbed by the discharge product reduces the resistance of the surface of the photoconductive drum 1, and electric charges are implanted to the surface of the photoconductive drum 1 at a charge nip N where the charging roller 2 and the photoconductive drum 1 are abutted against each other.

4. Principle of Image Smearing Detection Method

Next, a principle of an image smearing detection method will be described. Mentioning states of surface potentials of the photoconductive drum 1, the terms "upstream" and "downstream" refer to upstream and downstream in a rotation direction that is a movement direction of the surface of the photoconductive drum 1.

Figure 8:
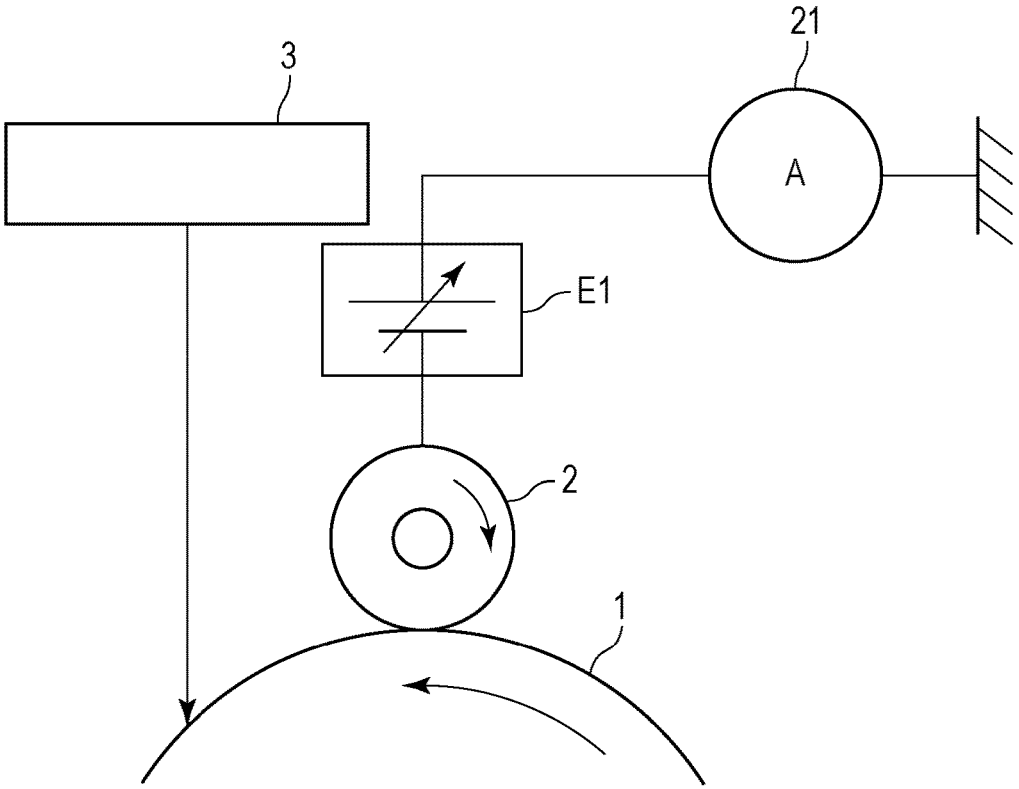
FIG. 8 is a schematic diagram illustrating a configuration for detecting image smearing according to Embodiment 1.

FIG. 8 is a schematic diagram illustrating a configuration of detection of image smearing with focus on one image forming unit S. The image smearing detection configuration has the photoconductive drum 1, the charging roller 2, the image exposure device 3, the charging power supply E1, and the current detecting circuit 21. It is assumed here that the developing device 4, the primary transfer roller 5, and the drum cleaning device 6 are detached.

In the detection configuration, the photoconductive drum 1 is rotated in a darker part of the H/H environment by charging with a predetermined charge amount. While the photoconductive drum 1 is rotating, the image exposure device 3 performs whole surface exposure on the photoconductive drum 1 such that the surface potentials of the photoconductive drum 1 reaching the charge nip N can be substantially equal to 0 V. The term "whole surface exposure" here refers to exposure with an exposure amount of the whole region of the exposurable range of the image exposure device 3 in the rotation axial direction of the photoconductive drum 1 such that the surface potential of the photoconductive drum 1 can be equal to substantially 0 V. Thus, the photoconductive drum 1 can easily cause image smearing. After that, in the darker part of the H/H environment, the following operations are performed. In other words, the charging process by the photoconductive drum 1 is terminated once, and the whole surface exposure is performed by the image exposure device 3 such that the surface potential of the whole region in the circumferential direction of the photoconductive drum 1 can be substantially equal to 0 V. Next, the exposure by the image exposure device 3 is terminated, and the photoconductive drum 1 is rotated at a circumferential velocity of approximately 150 mm/sec while direct current voltage equal to −400 V lower than the discharge start voltage Vth is started to apply to the charging roller 2. Then, after the photoconductive drum 1 is rotated for a predetermined period of time, the whole surface exposure on the photoconductive drum 1 by the image exposure device 3 is started by keeping the application of the direct current voltage lower than discharge start voltage Vth and rotation of the photoconductive drum 1.

Figure 9:
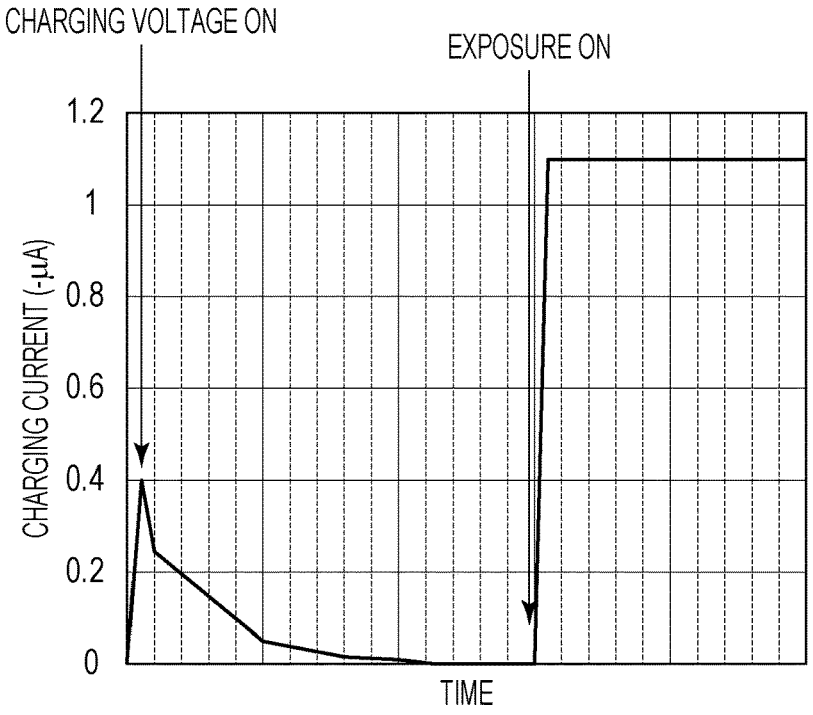
FIG. 9 is a graph for explaining a principle of a method for detecting image smearing according to Embodiment 1.

FIG. 9 is a graph illustrating results of measurements of a relationship between time periods from start of application of direct current voltage lower than the discharge start voltage Vth and electric current values detected by the current detecting circuit 21. In the photoconductive drum 1 with image smearing, even when direct current voltage lower than the discharge start voltage Vth is applied to the charging roller 2, slight potentials are formed on the surface of the photoconductive drum 1 in the downstream side of the charge nip N due to implanted charging, as described above. Therefore, in the photoconductive drum 1 with image smearing, electric current instantly flows if direct current voltage lower than the discharge start voltage Vth is started to apply to the charging roller 2 when the surface of the photoconductive drum 1 without potentials passes by the charge nip N. Thus, the current detecting circuit 21 detects electric current. After that, by keeping the application of direct current voltage lower than the discharge start voltage Vth and by keeping the rotation of the photoconductive drum 1 at the same time, the surface potentials of the photoconductive drum 1 are stabilized after passing by the charge nip N a plurality of number of times, resulting in no flow of electric current. Thus, the current detecting circuit 21 no longer detects electric current. If, in this state, the surface potentials of the photoconductive drum 1 in the upstream side of the charge nip N is cancelled to substantially 0 V due to the whole surface exposure by the image exposure device 3, and when the exposed region having undergone the whole surface exposure reaches the charge nip N, electric current flows again because of implanted charging. This phenomenon may be caused by a difference in surface potential of the photoconductive drum 1 before and after passing by the charge nip N. Thus, the current detecting circuit 21 detects electric current again. Therefore, it can be judged that, for example, in a case where a predetermined threshold value is set and the value of the electric current flowing then is equal to or greater than the threshold value, image smearing may easily occur. With this configuration according to this embodiment, it can be judged that image smearing may easily occur if the value of fed electric current is equal to or greater than an absolute value of 1 μA, for example.

On the other hand, in the photoconductive drum 1 without image smearing, performing the same operations does not result in formation of potentials on the surface of the photoconductive drum 1 in the downstream side of the charge nip N when direct current voltage lower than the discharge start voltage Vth is started to apply and the exposure region reaches the charge nip N. Thus, in the photoconductive drum 1 without image smearing, when the same operations are performed, current detecting circuit 21 does not detect electric current.

According to this embodiment, this phenomenon as described above is used to detect whether the photoconductive drum 1 has a state that it may easily cause image smearing or not. Although the current detecting circuit 21 according to this embodiment is directly connected to the charging power supply E1, it may be connected between the photoconductive drum 1 and a ground, for example. Although, according to this embodiment, the current detecting circuit 21 is used to detect a value of electric current which flows when a predetermined amount of voltage is applied from the charging power supply E1 to the charging roller 2, the voltage value when a predetermined amount of electric current is fed from the charging power supply E1 to the charging roller 2 may be detected. For example, the control unit 50 can change a set value for an output of the charging power supply 21 such that the electric current value detected by the current detecting circuit 21 can be a predetermined value. Thus, a voltage value can be detected from the set value for the output of the charging power supply E1 when a predetermined electric current value is obtained. In this case, the control unit 50 can function as a detecting unit configured to detect a voltage value. In other words, the detecting unit may detect one of an electric current change and a voltage change when voltage is applied from the charging power supply E1 to the charging roller 2.

Here, according to this embodiment, each of a plurality of photoconductive drums 1 is identified based on detection results provided by the common current detecting circuit 21, and whether each of the photoconductive drums 1 easily causes image smearing or not is detected, details of which will be described below. Accordingly, during the image smearing detection operation, the plurality of photoconductive drums 1 does not receive electric current even when direct current voltage lower than the discharge start voltage Vth is applied to the charging roller 2. According to this embodiment, while direct current voltage lower than discharge start voltage Vth is being applied to the charging roller 2, as described above, the photoconductive drum 1 is being rotated. Then, a fact is used in which the surface potentials of the whole region in the circumferential direction of the photoconductive drum 1 are saturated after a lapse of a predetermined period of time.

Figure 10:
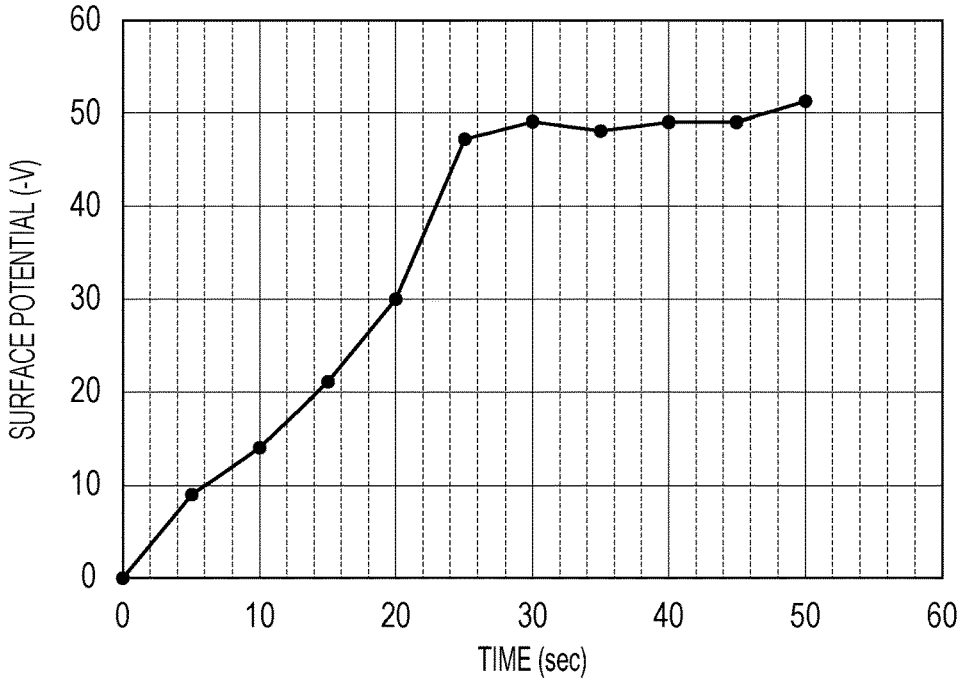
FIG. 10 is a graph illustrating transitions of time of surface potentials of the photoconductive drum with image smearing according to Embodiment 1.

FIG. 10 is a graph illustrating results of measurements of a relationship between time periods and surface potentials of the photoconductive drum 1 in a case where −400 V direct current voltage lower than the discharge start voltage Vth is applied to the charging roller 2 and the photoconductive drum 1 is rotated at a circumferential velocity of approximately 150 mm/sec. The surface potentials of the photoconductive drum 1 increase every time the surface passes by the charger, and the surface potentials of the photoconductive drum 1 finally saturate in about 30 seconds. Therefore, when −400 V direct current voltage is applied to the charging roller 2, rotating the photoconductive drum 1 for at least 30 seconds prevents substantial flow of electric current even though the direct current voltage is applied.

In this way, in a state where surface potentials of the photoconductive drum 1 saturate, the image exposure device 3 performs the whole surface exposure on a predetermined region in the circumferential direction of the photoconductive drum 1. Then, the electric current that flows due to implanted charging when the exposure region of the photoconductive drum 1 reaches the charge nip N is detected by the current detecting circuit 21. In other words, the electric current does not flow until the exposure region of the photoconductive drum 1 reaches the charge nip N, but electric current flows at an instance when the exposure region of the photoconductive drum 1 with easy occurrence of image smearing reaches the charge nip N. Therefore, the electric current can be detected by the current detecting circuit 21. Therefore, whether image smearing can easily occur or not in the current state can be detected.

Referring to FIGS. 5 and 6, as the surface potential of the photoconductive drum 1 increases due to the implanted charging, the value of electric current flowing during the implanted charging increases. For detection of electric current due to implanted charging with high accuracy, the electric current may be detected under a condition that the value of the electric current flowing due to implanted charging can increase as much as possible. Therefore, the value of direct current voltage lower than the discharge start voltage Vth to be used for the image smearing detection operation may be as high as possible. In view of this point, the value of direct current voltage lower than the discharge start voltage Vth to be used for the image smearing detection operation was −400 V according to this embodiment. According to this embodiment, the circumferential velocity of the photoconductive drum 1 during the image smearing detection operation is about 150 mm/sec that is substantially equal to that for image forming.

5. Control Procedure

Next, a control procedure will be described for the image smearing detection operation and the image smearing suppression operation according to this embodiment.

5-1. Outline of Control Procedure

Figure 11:
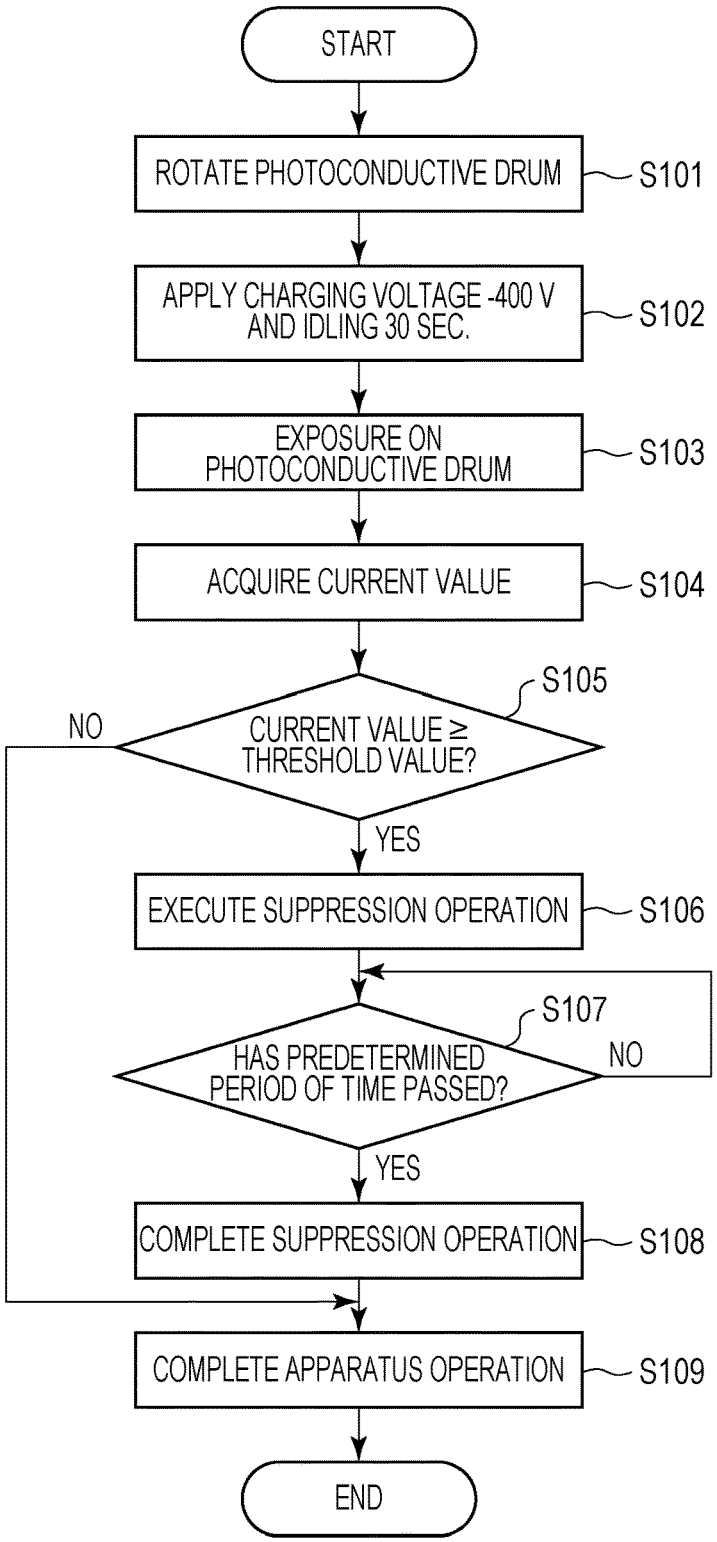
FIG. 11 is a flowchart for schematically explaining a control procedure over image smearing detection operations and image smearing suppression operations according to Embodiment 1.

First, for easy understanding of the present disclosure, an outline of a control procedure for the image smearing detection operation and the image smearing suppression operation will be described with focus on one image forming unit S. FIG. 11 is a flowchart illustrating an overview of a control procedure for the image smearing detection operation and the image smearing suppression operation with focus on one image forming unit S. Referring to FIG. 11, schematically, the operation to be performed in S102 to S105 corresponds to the image smearing detection operation, and the operation in S106 to S108 corresponds to the image smearing suppression operation.

At a time for execution of an image smearing detection operation, the control unit 50 rotates the photoconductive drum 1 (S101). The control unit 50 then starts applying direct current voltage lower than the discharge start voltage Vth to the charging roller 2 and keeps the rotation of the photoconductive drum 1 for 30 seconds (S102). In this case, the image exposure device 3 has an OFF state, and the development roller 41 is separated from the photoconductive drum 1 so that the development voltage has an OFF state. The primary transfer roller 5 is separated from the photoconductive drum 1 so that the primary transfer voltage has an OFF state. While the photoconductive drum 1 is rotating at a time of execution of the image smearing detection operation such as a case where the control is to be executed during the post-rotation process, the rotation may be continued. Here, before the time for execution of the image smearing detection operation, the surface potential of the whole region in the circumferential direction of the photoconductive drum 1 has substantially 0 V. If the photoconductive drum 1 has a state that image smearing easily occurs due to the operation, the surface potentials of the photoconductive drum 1 may saturate after electric current flows due to implanted charging so that electric current does not flow.

Next, the control unit 50 causes the image exposure device 3 to perform the whole surface exposure on a predetermined region in the circumferential direction of the photoconductive drum 1 by keeping the application of direct current voltage lower than the discharge start voltage Vth and keeping rotation of the photoconductive drum 1 (S103). Next, the control unit 50 obtains a detection result of the current detecting circuit 21 when the exposure region of the photoconductive drum 1 reaches the charge nip N and direct current voltage lower than the discharge start voltage Vth is applied to the exposure region (S104). Next, the control unit 50 judges whether an electric current value equal to or greater than the threshold value has been detected by the current detecting circuit 21 or not (S105). If it is judged in S105 that an electric current value equal to or greater than the threshold value has been detected, the control unit 50 determines to execute an image smearing suppression operation and subsequently starts an image smearing suppression operation (S106). After that, the control unit 50 executes the image smearing suppression operation for a predetermined time (S107), then completes the image smearing suppression operation (S108), and terminates the operation (S109). On the other hand, if it is judged in S105 that an electric current value equal to or greater than the threshold value has not been detected, the control unit 50 terminates the operation without execution of the image smearing suppression operation (S109).

Here, the application of direct current voltage to the charging roller 2 is kept from saturation of surface potentials of the photoconductive drum 1 to the passage of the exposure region of the photoconductive drum 1 by the charge nip N. However, the application of the direct current voltage may be terminated once after surface potentials of the photoconductive drum 1 saturate, and the application of the direct current voltage may start again when the exposure region of the photoconductive drum 1 reaches the charge nip N. Then, the direct current voltage for obtaining a detection result from the current detecting circuit 21 can be applied during a period when the exposure region of the photoconductive drum 1 is passing by the charge nip N.

Here, according to this embodiment, in an image smearing suppression mode for the image smearing suppression operation, the photoconductive drum 1 may be rotated for a predetermined time, and the cleaning blade 61 may perform a frictional sliding operation on the surface of the photoconductive drum 1. However, the image smearing suppression operation may be an arbitrary operation which can reduce an influence of a discharge product attached to the surface of the photoconductive drum 1. Typically, the operation may remove discharge generating unit from the surface of the photoconductive drum 1 or may suppress reduction of resistance of the surface of the photoconductive drum 1 due to moisture absorption by a discharge product as a result of drying of the surface of the photoconductive drum 1. For example, in order to remove a discharge product from the surface of the photoconductive drum 1, a frictional sliding member such as a rotatable roll-shaped brush may be abutted and rolled against the surface of the photoconductive drum 1, for example, alternatively to the operation of this embodiment. In order to dry the surface of the photoconductive drum 1, a heating unit such as a heater provided in an internal, hollow, surrounding part of the photoconductive drum 1 or at an arbitrary position within the apparatus main body 110 of the image forming apparatus 100 can be used to heat the surface or surroundings of the photoconductive drum 1.

5-2. Problems of Configuration with a Plurality of Photoconductive Drums

Next, problems will be described in a case where the aforementioned control procedure is applied to the image forming apparatus 100 including a plurality of photoconductive drums 1.

As described above, a change in electric current due to implanted charging caused by applied direct current voltage lower than the discharge start voltage Vth to the charging roller 2 can be detected to determine whether a state is acquired in which image smearing easily occurs or not. However, according to this embodiment, the image forming apparatus 100 may only include the single current detecting circuit 21 for the plurality of photoconductive drums 1 for reduced size and costs of the apparatus. Therefore, simple application of the aforementioned control procedure cannot detect whether each identified one of a plurality of photoconductive drums 1 has a state that image smearing easily occur or not. In other words, the image forming apparatus 100 of this embodiment detects a total amount of electric current that is a total amount of electric current fed to the charging rollers 2 for all image forming units S by the common current detecting circuit 21. Therefore, it may be difficult to detect electric current fed to the charging roller 2 of each of the image forming units S.

A case will be considered in which, after surface potentials of the all photoconductive drums 1 are saturated under the control procedure, the image exposure device 3 performs whole surface exposure simultaneously on all of the photoconductive drums 1. Also in this case, when there is a photoconductive drum 1 with image smearing, the current detecting circuit 21 detects electric current flowing due to implanted charging. However, in this case, because the exposure regions of all of the photoconductive drums 1 simultaneously reach the charge nip N, if even one of a plurality of photoconductive drums 1 is a photoconductive drum 1 with image smearing, current detecting circuit 21 detects electric current flowing due to implanted charging. Therefore, which photoconductive drum 1 of the plurality of photoconductive drums 1 has a state that image smearing easily occurs cannot be detected. Furthermore, how much the image smearing easily occurs in each of the photoconductive drums 1 cannot be judged. Therefore, in this case, if there is one photoconductive drum 1 having a state that image smearing easily occurs, the image smearing suppression operation cannot be executed uniformly on all of the photoconductive drums 1. This may lead wearing and consumption of members and materials involved in the image smearing suppression operation and an increase of a downtime for the image smearing suppression operation, that is, an increase of a period when no image can be output.

Figure 12:
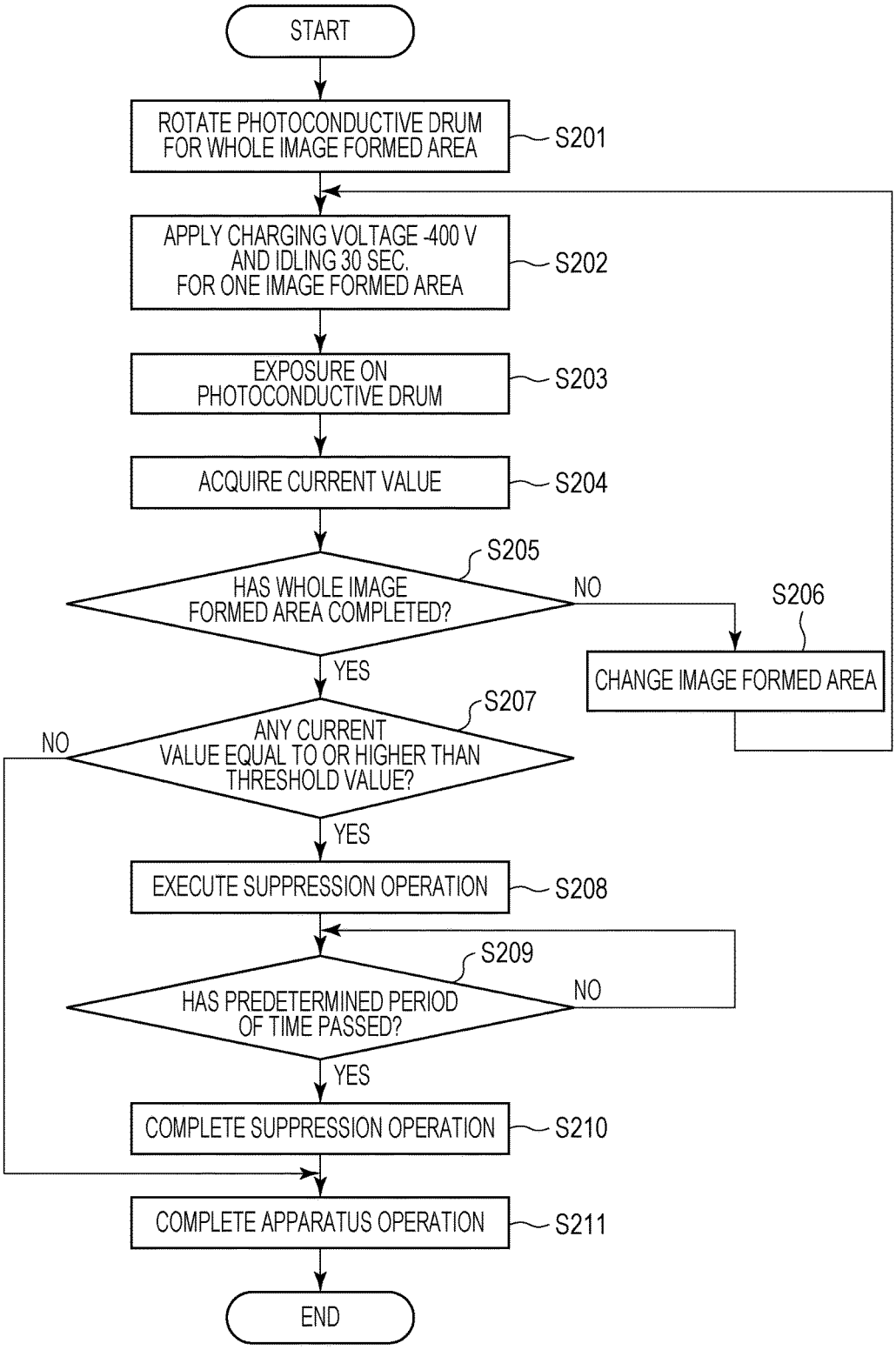
FIG. 12 is a flowchart illustrating image smearing detection operations and image smearing suppression operations according to a comparative example of Embodiment 1.

Next, as an example of a method for identifying each of a plurality of photoconductive drums 1 by using the common current detecting circuit 21 and detecting which has a state that image smearing easily occurs, the following method as illustrated in a flowchart in FIG. 12 will be described.

At a time for execution of an image smearing detection operation, the control unit 50 rotates all photoconductive drums 1 (S201). Although it is assumed here that a plurality of photoconductive drums 1 are simultaneously rotated by a single drive motor, a plurality of photoconductive drums 1 may be started to rotate simultaneously or at different times. The plurality of photoconductive drums 1 may be driven to rotate by a single drive motor or individual independent drive motors. Next, the control unit 50 causes the processing in 5202 to 5204 that are the same as the processing in 5102 to 5104 in FIG. 11 on the first image forming unit SY to acquire a detection result from the current detecting circuit 21. After that, until the acquisition of the detection results from the current detecting circuit 21 with respect to all image forming units S completes (S205), the control unit 50 repeats the processing in 5202 to 5204 by sequentially changing the second, third, fourth image forming units SM, SC, and SK (S206).

Next, after completion of the acquisition of detection results from the current detecting circuit 21 with respect to all of the image forming units S, the control unit 50 judges and identifies whether there is an image forming unit S from which electric current equal to or greater than a threshold value is detected by the current detecting circuit 21 or not (S207). Then, the control unit 50 executes the image smearing suppression operation over a predetermined time on the image forming unit S from which the current detecting circuit 21 detects that electric current value equal to or greater than the threshold value in 5207 and then completes the operation (S208 to S211). On the other hand, the control unit 50 does not execute the image smearing suppression operation for an image forming unit S from which the current detecting circuit 21 does not detect an electric current value equal to or greater than the threshold value in 5207 and completes the operation (S211).

Also according to this method, each of a plurality of photoconductive drums 1 can be identified, and whether they have a state that image smearing easily occur or not can be detected. However, it may be difficult for this method to perform an image smearing detection operation on an image forming unit S until the image smearing detection operation performed on another image forming unit S completes, which takes time for control and leads an increased downtime.

According to this embodiment, the following control procedure is applied to reduce time for control and enables identification of each of a plurality of photoconductive drums 1 and detection of whether each of them has a state that image smearing easily occur.

5-3. Control Procedure of this Embodiment

Figure 13:
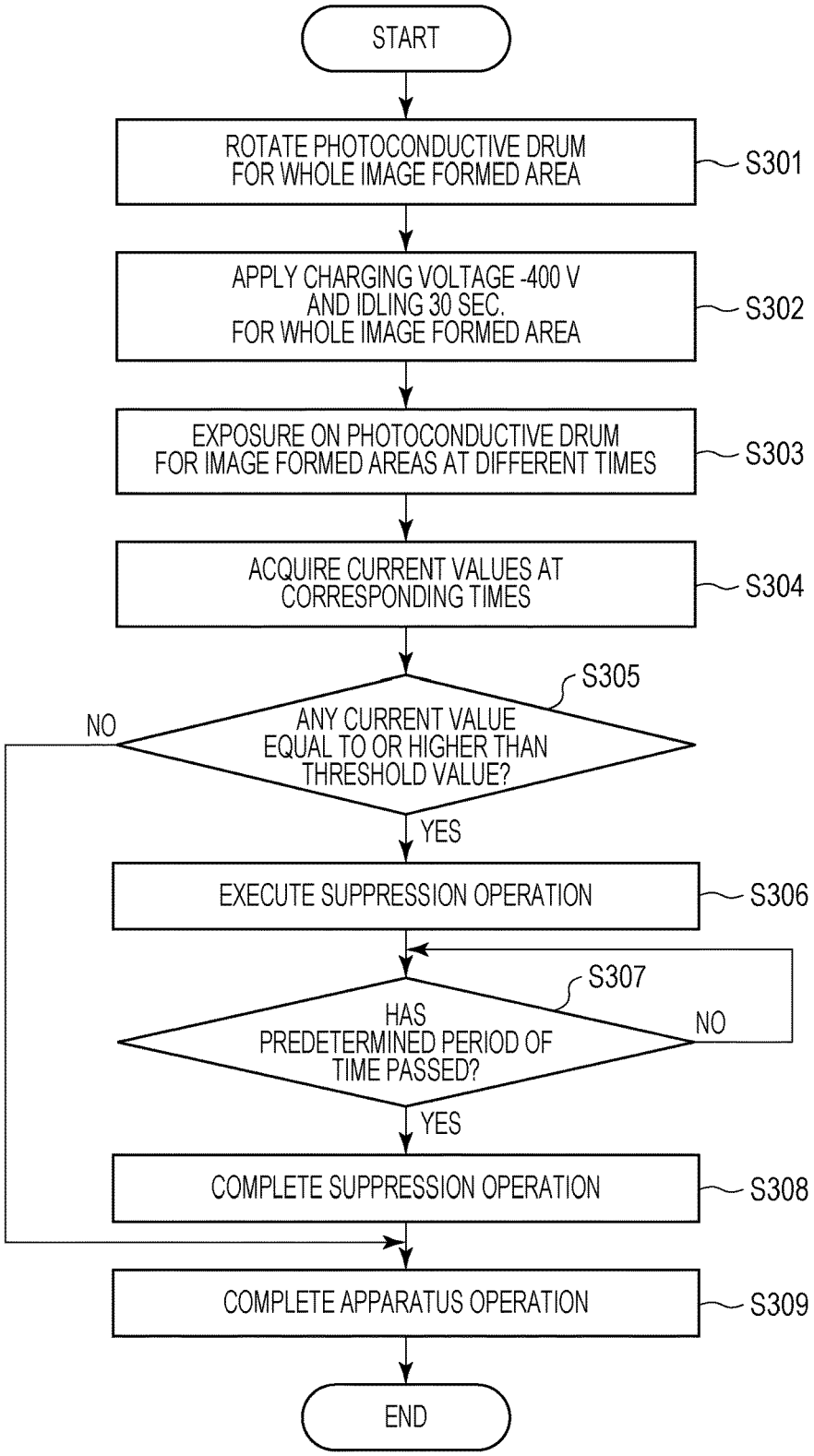
FIG. 13 is a flowchart illustrating image smearing detection operations and image smearing suppression operations according to Embodiment 1.

Next, control procedures for the image smearing detection operation and the image smearing suppression operation according to this embodiment will be described. FIG. 13 is a flowchart illustrating an overview of control procedures over the image smearing detection operation and image smearing suppression operation according to this embodiment. Referring to FIG. 13, schematically, the processing in S302 to S305 corresponds to the image smearing detection operation, and the processing in S306 to S308 corresponds to the image smearing suppression operation.

According to this embodiment, the image smearing detection operation and the image smearing suppression operation are executed during a non-image-forming period by the control unit 50. More specifically, the image smearing detection operation is executed during the post-rotation process after the last image forming in a job completes in the image forming unit S. In the image smearing detection operation, if it is determined to execute an image smearing suppression operation, the image smearing suppression operation is executed during the post-rotation process. According to this embodiment, the image smearing detection operation is executed typically during a period from completion of the last image formation in a job in the image forming unit S, passage of a recording material P having the image transferred thereon through the fixing device 9 and discharge it externally to the apparatus main body 110 of the image forming apparatus 100. If it is determined in the image smearing detection operation that an image smearing suppression operation is to be executed, the image smearing suppression operation is executed over a predetermined period which may be beyond after discharge of the recording material P externally to the apparatus main body 110.

At a time for execution of an image smearing detection operation, the control unit 50 simultaneously rotate photoconductive drums 1 of all of the image forming units S (S301). The control unit 50 then simultaneously starts application of direct current voltage lower than the discharge start voltage Vth to the charging rollers 2 of all of the image forming unit S and keeps the rotations of the photoconductive drums 1 of all of the image forming units S for 30 seconds (S302). In this case, in all of the image forming unit S, the image exposure device 3 has an OFF state, and the development roller 41 is separated from the photoconductive drum 1 so that the development voltage has an OFF state. The primary transfer roller 5 is separated from the photoconductive drum 1 so that the primary transfer voltage has an OFF state. According to this embodiment, because the control is executed in the post-rotation process, the photoconductive drums 1 are kept rotating during a period from completion of image forming to execution of the image smearing detection operation. According to this embodiment, before the time for execution of the image smearing detection operation, the surface potential of the whole region in the circumferential direction of the photoconductive drum 1 has substantially 0 V.

Next, the control unit 50 causes the application of direct current voltage lower than the discharge start voltage Vth by keeping the rotations of the photoconductive drums 1 in all of the image forming unit S. Then, in each of the image forming units S, predetermined regions in the circumferential direction of the photoconductive drums 1 undergo whole surface exposure by the image exposure device 3 at different times (S303). In other words, according to this embodiment, whole surface exposure is performed on the predetermined region in the circumferential direction of the photoconductive drum 1Y in the first image forming unit SY. Next, before the exposure region of the photoconductive drum 1Y in the first image forming unit SY reaches the charge nip N, whole surface exposure is performed on the predetermined region in the circumferential direction of the photoconductive drum 1M in the second image forming unit SM. Next, before the exposure region of the photoconductive drum 1Y in the first image forming unit SY reaches the charge nip N, whole surface exposure is performed on the predetermined region in the circumferential direction of the photoconductive drum 1C in the third image forming unit SC. Next, before the exposure region of the photoconductive drum 1Y in the first image forming unit SY reaches the charge nip N, whole surface exposure is performed on the predetermined region in the circumferential direction of the photoconductive drum 1K in the fourth image forming unit SK. Thus, the exposure regions of the photoconductive drums 1 in the image forming units S reach the charge nip N at different times.

Figure 14:
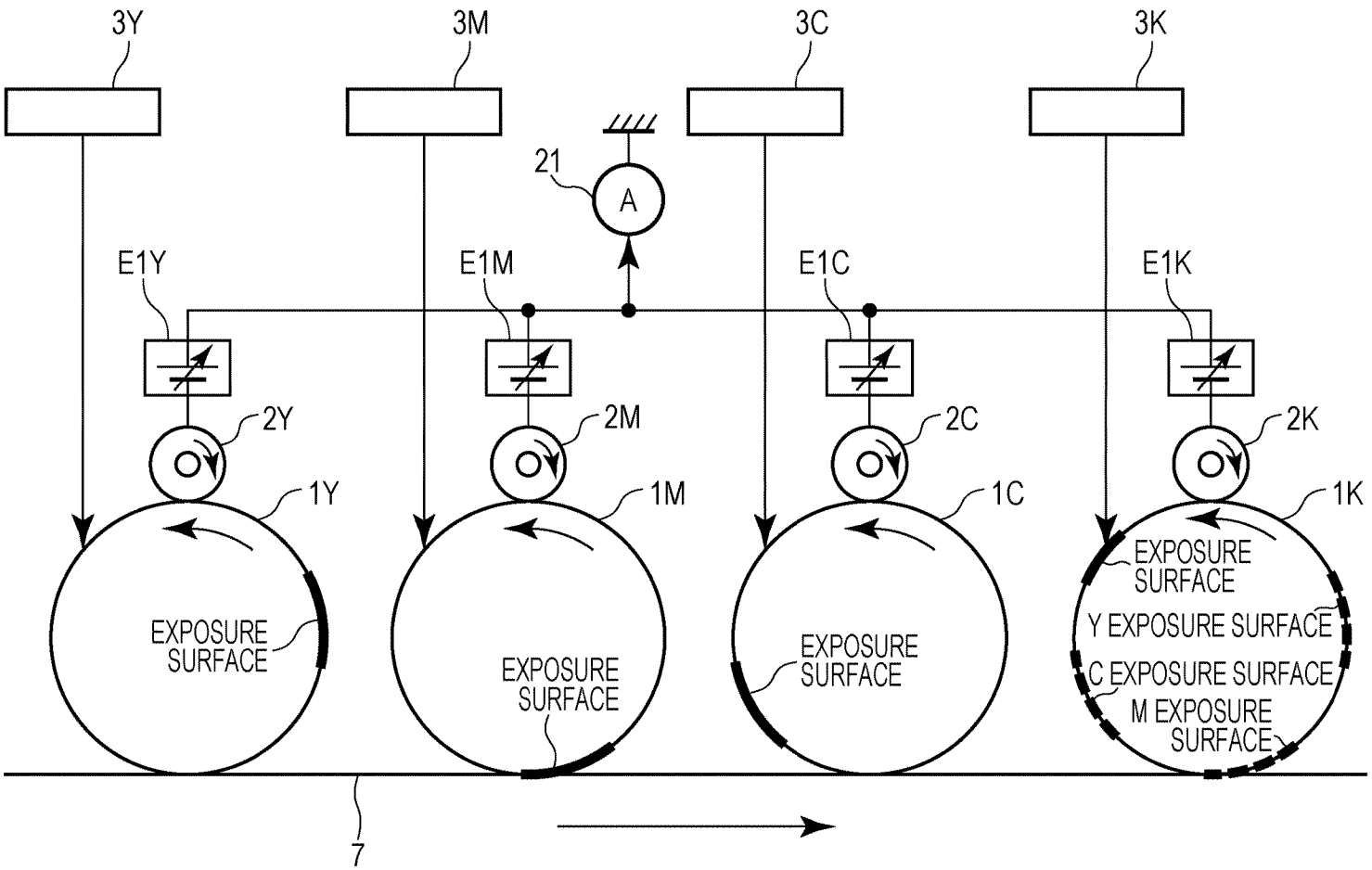
FIG. 14 is a schematic diagram for explaining exposure timing for a plurality of photoconductive drums according to Embodiment 1.

FIG. 14 is a schematic diagram illustrating phases of the photoconductive drums 1 at exposure region positions of the photoconductive drums 1 in the image forming unit S when whole surface exposure is being performed on the photoconductive drum 1K in the fourth image forming unit SK. The phases of the exposure regions of the photoconductive drums 1 in the image forming units S are different as illustrated in FIG. 14. Thus, the exposure regions of the photoconductive drums 1 in the image forming units S reach the charge nip N at different times. Therefore, direct current voltage lower than the discharge start voltage Vth is applied to the exposure regions of the photoconductive drums 1 in the image forming units S, and the current detecting circuit 21 detects the electric current therefrom at different times. In order to reduce the time period for the control as short as possible, the whole surface exposure in the fourth image forming unit SK may complete before the exposure region of the photoconductive drum 1Y in the first image forming unit SY reaches the charge nip N. However, the present disclosure is not limited thereto, but the application of direct current voltage lower than the discharge start voltage Vth to the exposure regions of the photoconductive drums 1 in a plurality of image forming units S and detection of electric current therefrom by the current detecting circuit 21 may be performed at different times. In other words, the exposure regions of the photoconductive drums 1 in the image forming units S may be at different phase positions with reference to the phase position of the exposure region of the photoconductive drum 1 in the first image forming unit SY.

Next, the control unit 50 obtains detection results from the current detecting circuit 21 when the exposure regions of the photoconductive drums 1Y, 1M, 1C, 1K reach the charge nip N and direct current voltage lower than the discharge start voltage Vth is applied to the exposure regions (S304). Next, the control unit 50 judges whether there is any image forming unit S having an electric current value equal to or greater than the threshold value detected by the current detecting circuit 21 or not and, if so, identifies the image forming unit S (S305). For the image forming unit S judged as having the electric current value equal to or greater than the threshold value detected by the current detecting circuit 21 in S305, the control unit 50 determines to execute the image smearing suppression operation and subsequently starts the image smearing operation (S306). After that, for the image forming unit S to undergo the image smearing suppression operation, the control unit 50 executes the image smearing suppression operation for a predetermined time (S307), completes the image smearing suppression operation (S308), and terminates the operation (S309). On the other hand, for the image forming unit S having an electric current value equal to or greater than the threshold value detected by the current detecting circuit 21 in S305, the control unit 50 terminates the operation without executing the image smearing suppression operation (S309).

Figure 15A:
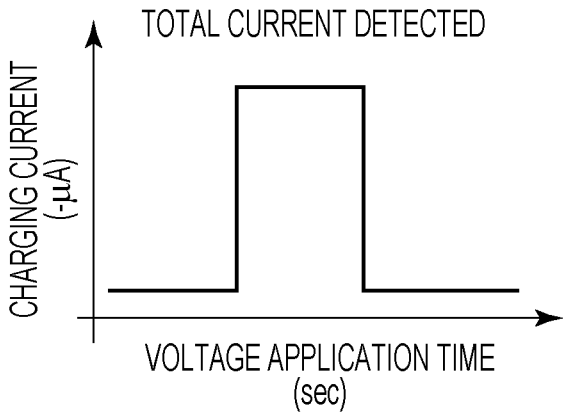
FIGS. 15A and 15B are graphs for explaining advantages according to Embodiment 1.
Figure 15B:
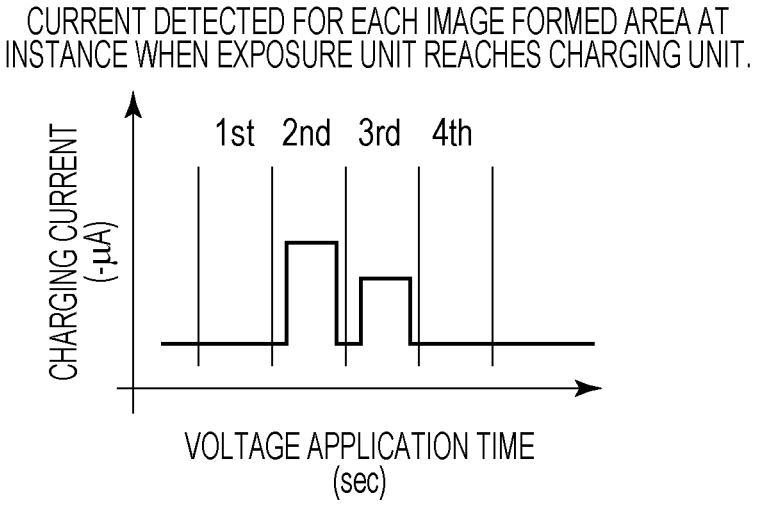

FIGS. 15A and 15B are schematic diagrams for explaining advantages of this embodiment. FIG. 15A illustrates detection results from the current detecting circuit 21 in a case where an image smearing detection operation is performed by a control procedure including simultaneously performing a whole surface exposure on all of the image forming units S, and FIG. 15B illustrates detection results from the current detecting circuit 21 in a case where the image smearing detection operation is performed by the control procedure according to this embodiment, as described above. It is assumed here that photoconductive drums 1M and 1C of the second and third image forming units SM and SC have a state that image smearing may easily occur.

As illustrated in FIG. 15A, in a case where all of the image forming units S undergo whole surface exposure at the same time, the current detecting circuit 21 simultaneously detects electric current fed to the charging roller 2 in all of the image forming units S. Therefore, the current detecting circuit 21 detects a total amount of electric current that is a total amount of electric current fed to the charging rollers 2M and 2C in the second and third image forming units SM and SC. This prevents each of the plurality of photoconductive drums 1 from being identified and from detecting whether they have a state that image smearing may easily occur or not.

On the other hand, as illustrated in FIG. 15B, in a case where the image forming units S undergo whole surface exposure at different times, the current detecting circuit 21 detects electric current fed to the charging roller 2 for each of the image forming unit S when the exposure region of the photoconductive drum 1 reaches the charge nip N. The control procedure according to this embodiment can identify each of the plurality of photoconductive drums 1 and can detect whether each of them has a state that image smearing may easily occur. In the example in FIG. 15B, the electric current fed to the charging rollers 2M and 2C may be detected only based on times when the exposure regions of the photoconductive drums 1M and 1C of the second and third image forming units SM and SC passes by the charge nip N. Therefore, based on association between the times when the exposure regions pass by the charge nip N and the image forming units S, it can be detected whether the photoconductive drums 1M and 1C of the second and third image forming units SM and SC have a state that image smearing may easily occur. In other words, it can be detected that the photoconductive drums 1Y and 1K of the first, fourth image forming units SY and SK do not have the state that image smearing may easily occur.

In the control procedure of this embodiment, how much each of a plurality of photoconductive drums 1 causes image smearing easily can be judged. In the example in FIG. 15B, the electric current fed to the charging roller 2M in the second image forming unit SM is larger than the electric current fed to the charging roller 2C in the third image forming unit SC. Therefore, it can be judged that the photoconductive drum 1M of the second image forming unit SM has a state that image smearing may easily occur more than the photoconductive drum 1C of the third image forming unit SM. This can change details of the image smearing suppression operation in accordance with how much image smearing may easily occur. For example, the execution time period of the image smearing suppression operation on the second image forming unit SM can be longer than the execution time period of the image smearing suppression operation on the third image forming unit SC. More specifically, for example, a plurality of threshold values may be defined, and the execution time period of the image smearing suppression operation can be increased in a case where the detected electric current value is equal to or greater than a second threshold value, compared with a case where the detected electric current value is equal to or greater than a first threshold value but is lower than the second threshold value. For example, details of the image smearing suppression operation can be changed based on information including, in association, an absolute value of an electric current value as a preset detection electric current value or an electric current value for a predetermined range of the photoconductive drums 1 and the type or operation time period of the operations for implementing preset details of the image smearing suppression operation.

According to this embodiment, as described above, the image forming apparatus 100 has the current detecting circuit 21 as a common detecting unit configured to detect a value of electric current that flows when voltage is applied to the charging rollers 2 being a plurality of abutting members by the charging power supply E1 or to detect a value of voltage caused thereby. The image forming apparatus 100 further has the control unit 50 functioning as a control unit configured to control to acquire information regarding surface potentials of a plurality of photoconductive drums 1 during a non-image-forming period. The control unit 50 is configured to the following controls. That is, the image exposure device 3 being an exposing unit exposes a plurality of photoconductive drums 1 to light at different times and thus form exposure regions on the plurality of photoconductive drums 1. When the exposure regions pass by the charge nips N to be abutted against the charging rollers 2, the charging power supplies E1 apply direct current voltage lower than the discharge start voltage Vth to the plurality of charging rollers 2 to acquire detection results from the current detecting circuit 21. Based on the acquired detection results, information regarding surface potentials of the plurality of photoconductive drums 1 is acquired. According to this embodiment, the separate charging power supplies E1 are provided which apply voltage to a plurality of charging roller 2 as the applying unit. According to this embodiment, in a state that the absolute values of the surface potentials of the plurality of photoconductive drums 1 are equal to or lower than a predetermined value, the control unit 50 performs the control to cause the charging power supplies E1 to apply direct current voltage lower than the discharge start voltage Vth to the plurality of charging rollers 2 for a predetermined time. Then, the control unit 50 forms exposure regions having absolute values of surface potentials equal to or lower than the predetermined value on the plurality of photoconductive drums 1. According to this embodiment, the predetermined value is substantially equal to 0 V. However, embodiments of the present disclosure are not limited thereto. The predetermined value may be lower than an absolute value of a surface potential which can be formed on the photoconductive drum 1 by application of direct current voltage lower than the discharge start voltage Vth to the charging roller 2. According to this embodiment, the control unit 50 controls to determine whether an operation for reducing an influence of a discharge product attached on the surfaces of the plurality of photoconductive drums 1 is to be executed based on the acquired information regarding the surface potentials of the plurality of photoconductive drums 1. According to this embodiment, when the exposure regions pass by the charge nips N and in a case where the absolute value of any electric current value or voltage value detected by the detecting unit is equal to or greater than a predetermined threshold value, the control unit 50 causes the photoconductive drum 1 corresponding to the exposure region to execute the aforementioned operation. In particular, according to this embodiment, the aforementioned operation is executed in a case where the value of electric current detected by the current detecting circuit 21 is equal to or greater than a predetermined threshold value. According to this embodiment, the exposure region is formed in an entire region that can be exposed by the image exposure device 3 in the direction substantially orthogonal to the movement direction of the surface of the photoconductive drum 1.

As described above, according to this embodiment, each of a plurality of photoconductive drums 1 is identified, and whether each of them has a state that image smearing may easily occur or not and how much it can be easily occur can be judged. Thus, a necessary degree of image smearing suppression operation can be executed for each of a plurality of photoconductive drums 1 as required, and image smearing due to a discharge product can be suppressed efficiently. Particularly, this embodiment can contribute to reduction of size and cost of the apparatus and can reduce time for the controls in addition to the advantages as described above.

Embodiment 2

Next, another embodiment of the present disclosure will be described. It is assumed here that basic configurations and operations of an image forming apparatus according to this embodiment are the same as those of the image forming apparatus of Embodiment 1. Therefore, like numbers refer to like parts having like function or configuration in image forming apparatuses according to Embodiments 1 and 2, and any repetitive detail descriptions will be omitted.

According to Embodiment 1, in the image smearing detection operation, when direct current voltage lower than the discharge start voltage Vth is applied to the charging rollers 2, the surface potentials of the photoconductive drums 1 are saturated by direct current voltage lower than the discharge start voltage Vth applied to prevent the plurality of photoconductive drums 1 from preventing electric current from flowing therethrough. On the other hand, according to this embodiment, direct current voltage equal to or greater than a discharge start voltage Vth is applied to the charging rollers 2 in all of the image forming units S so that the entire region of the photoconductive drum 1 in the circumferential direction can be charged by discharging. According to this embodiment, −1200 V direct current voltage is applied to the charging rollers 2 to charge the photoconductive drums 1 to −650 V that is substantially equal to that for image forming. After that, like Embodiment 1, when exposure regions formed at different times pass by the charge nip N, direct current voltage lower than the discharge start voltage Vth is applied to the charging rollers 2 in a plurality of photoconductive drums 1, and the resulting flowing electric current is detected by the current detecting circuit 21. Thus, when the exposure region of the photoconductive drum 1 in one image forming unit S passes by the charge nip N, the charge region charged by discharging of the photoconductive drum 1 in another image forming unit S passes by the charge nip N. Even when voltage lower than the discharge start voltage Vth is applied to the charge region of the photoconductive drum 1, electric current does not substantially feed to the charging roller 2. Thus, when the exposure region in the one image forming unit S passes by the charge nip N and when direct current voltage lower than the discharge start voltage Vth is applied to the charging rollers 2 in all of the image forming units S, electric current is not substantially fed to the charging roller 2 in the other image forming unit S.

Figure 16:
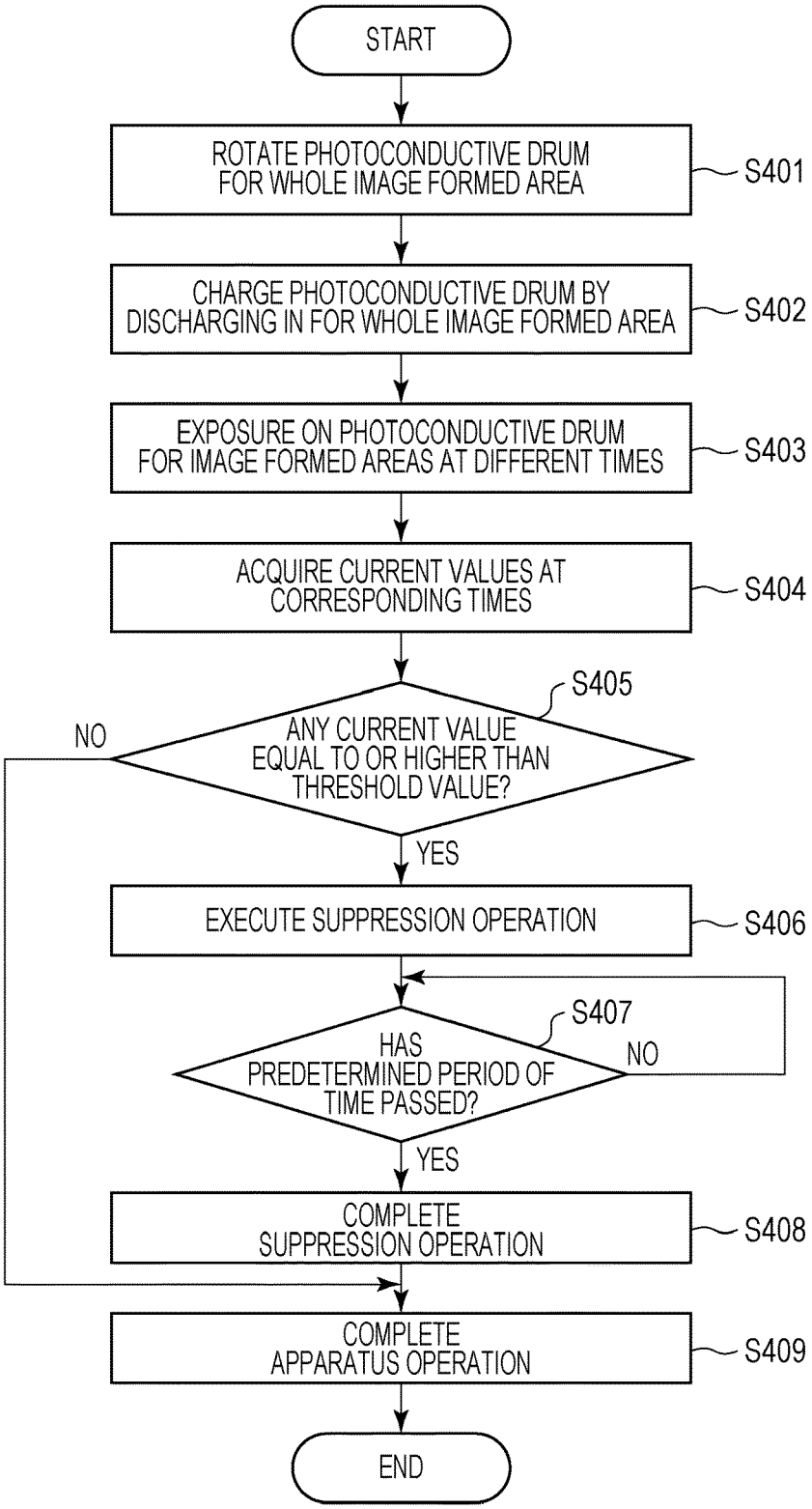
FIG. 16 is a flowchart illustrating image smearing detection operations and image smearing suppression operations according to Embodiment 2.

FIG. 16 is a flowchart illustrating an overview of a control procedure for an image smearing detection operation and an image smearing suppression operation according to this embodiment. The processing in S401 and S403 to S409 in FIG. 16 is the same as the processing in S301 and S303 to S309 in FIG. 13.

According to this embodiment, in S402, the control unit 50 simultaneously starts applying direct current voltage equal to or greater than discharge start voltage Vth to the charging rollers 2 in all image forming units S and thus charges the entire regions in the circumferential direction of the photoconductive drum 1 by discharging. Next, in S403, the control unit 50 changes the direct current voltage applied to the charging roller 2 to direct current voltage lower than the discharge start voltage Vth by keeping the rotation of the photoconductive drums 1 in all of the image forming units S. Then, the control unit 50 causes the image exposure device 3 to perform whole surface exposure on predetermined regions in the circumferential direction of the photoconductive drums 1 in the image forming units S at different times.

According to this embodiment, the control unit 50 charges a plurality of photoconductive drums 1 by discharging, and an exposure region is then formed which has an absolute value of the surface potentials equal to or lower than a predetermined value in each of the plurality of photoconductive drums 1. Although the predetermined value is substantially equal to 0 V according to this embodiment, embodiments of the present disclosure are not limited thereto. The predetermined value may be lower than the absolute value of a surface potential that can be formed on the photoconductive drum 1 by direct current voltage lower than the discharge start voltage Vth applied to the charging roller 2.

As described above, the control procedure according to this embodiment can also provide the same advantages as those of Embodiment 1.

Embodiment 3

Next, another embodiment of the present disclosure will be described. It is assumed here that basic configurations and operations of an image forming apparatus according to this embodiment are the same as those of the image forming apparatus of Embodiment 1. Therefore, like numbers refer to like parts having like function or configuration in image forming apparatuses according to Embodiments 1 and 3, and any repetitive detail descriptions will be omitted.

Figure 17:
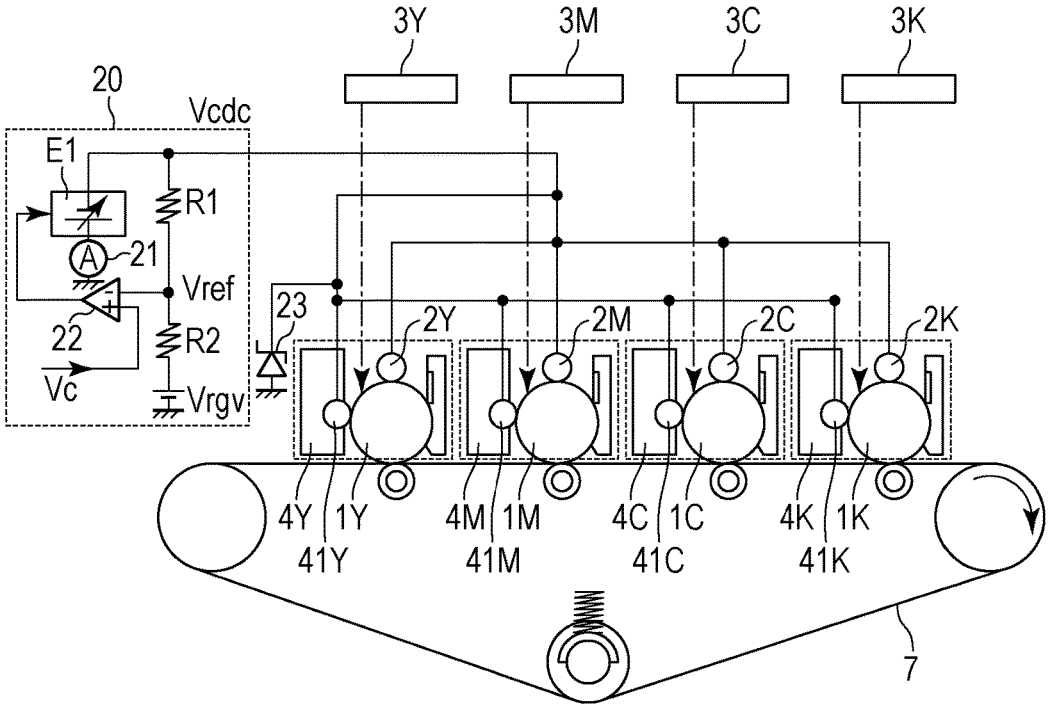
FIG. 17 is a schematic cross-sectional view illustrating a main part of an image forming apparatus according to Embodiment 3.

FIG. 17 is a schematic cross-sectional view illustrating a schematic configuration of a main part of an image forming apparatus 100 according to Embodiment 3. According to this embodiment, a common power supply is used to apply direct current voltage to charging rollers 2 in a plurality of image forming units S. In other words, according to this embodiment, the applying unit has a common charging power supply E1 configured to apply voltage to a plurality of charging rollers 2.

The image forming apparatus 100 includes a power supply device 20 having a charging power supply E1 and a current detecting circuit 21. The charging power supply E1 includes a transformer and a transformer-drive/control system. Charging rollers 2Y, 2M, 2C, 2K in first, second, third, and fourth image forming units SY, SM, SC, SK are connected to the charging power supply E1. The charging power supply E1 is configured to supply charging voltage Vcdc output from a negative transformer to the charging rollers 2Y, 2M, 2C, and 2K. In other words, according to this embodiment, direct current voltage is applied from the single charging power supply E1 to the charging rollers 2Y, 2M, 2C, and 2K in the first, second, third, and fourth image forming units SY, SM, SC, and SK. According to this embodiment, direct current voltage applied from the charging power supply E1 to the charging roller 2 in each of the image forming units S can be adjusted by one operation with a predetermined relationship kept therebetween. However, the direct current voltage applied to the charging roller 2 cannot be independently adjusted between the image forming units S. According to this embodiment, current detecting circuit 21 is directly connected to the charging power supply E1.

According to this embodiment, negative voltage acquired by stepping down the charging voltage Vcdc by R2/(R1+R2) by resistance elements R1 and R2 is offset to voltage with a positive polarity about a reference voltage Vrgv so that a monitor voltage Vref can be acquired. The monitor voltage Vref undergoes feedback control to a predetermined value for controlling to keep a substantially even charging voltage Vcdc. More specifically, preset control voltage Vc is input from the CPU 51 in the control unit 50 to a positive terminal of the operational amplifier 22, and the monitor voltage Vref is input to a negative terminal of the operational amplifier 22. The control voltage Vc may be changed by the control unit 50 in accordance with a given environment, for example. The transformer-drive/control system in the charging power supply E1 is feedback-controlled by an output value from the operational amplifier 22 such that the monitor voltage Vref can be equal to the control voltage Vc. Thus, the charging voltage Vcdc output from the transformer in the charging power supply E1 is controlled to a target value.

Here, the resistance elements R1 and R2 may be one of a fixed resistance, a semi-fixed resistance, and a variable resistance. According to this embodiment, power supply voltage is directly input from the transformer in the charging power supply E1 to the charging rollers 2Y, 2M, 2C, and 2K. However, embodiments of the present disclosure are not limited to the voltage input configuration. Various voltage input configurations may be considered to the charging rollers 2 or development rollers 41. For example, converted voltage acquired by performing DC-DC conversion on an output from the transformer or voltage acquired by dividing or stepping down power supply voltage converted voltage by an electronic element having a fixed voltage drop characteristic may be input to the charging rollers 2 or development rollers 41. The electronic element having a fixed voltage drop characteristic may be a resistance element that is a zener diode 23, for example, in FIG. 17. The converter may include a variable regulator. The dividing or stepping down by an electronic element may include further stepping down divided voltage or, conversely, further dividing stepped-down voltage. With respect to the transformer output control configuration, an output from the operational amplifier 22 may be input to the CPU 51 in the control unit 50, and a calculation result provided by the CPU 51 in the control unit 50 may be reflected to the transformer-drive/control system.

According to this embodiment, a plurality of image forming units S share the charging power supply E1. Thus, it is difficult to change times for forming potentials on the photoconductive drums 1 in a plurality of image forming units S. According to this embodiment, a plurality of image forming units S share the current detecting circuit 21. Thus, according to this embodiment, the current detecting circuit 21 can detect a total amount of electric current that is a total amount of electric current fed to the plurality of charging rollers 2.

Also with this configuration, the image smearing detection operation may be performed in the same manner as that in Embodiments 1 and 2 so that each of a plurality of photoconductive drums 1 can be identified, whether each of them has a state that image smearing may easily occur or not can be detected, and how much the state may easily occur can be judged. Thus, the same advantages as those of Embodiments 1 and 2 can be acquired.

Others

Having described the present disclosure with reference to specific embodiments up to this point, the present disclosure is not limited to the aforementioned embodiments.

According to the aforementioned embodiments, the image forming apparatus 100 has a drum cleaning device 6 configured to remove residual toner on a surface of a photoconductive drum 1 after a primary transfer operation. On the other hand, a cleanerless image forming apparatus may be provided which does not have a specific drum cleaning device 6 configured to remove residual toner on a surface of the photoconductive drum 1. In such a cleanerless image forming apparatus, schematically, residual toner on a surface of the photoconductive drum 1 is charged by the charging roller 2 and is then partially collected by the developing device 4 through the development roller 41. The other toner is used to form a subsequent toner image. The photoconductive drum 1 has a surface generally having a low surface friction coefficient μ and being hard so that it is not easy to be scraped off and that a discharge product attached to the surface of the photoconductive drum 1 is not easily removed. In the image forming apparatus 100 having the cleaning device 6, a discharge product attached to the surface of the photoconductive drum 1 may undergo frictional sliding by the cleaning device 6 for easy removal of the discharge product. However, in the cleanerless image forming apparatus without the cleaning device 6 which performs frictional sliding on the surface of the photoconductive drum 1, a discharge product is easily attached and accumulated onto the surface of the photoconductive drum 1. As a result, image smearing due to the discharge product may easily occur. On the other hand, in the cleanerless image forming apparatus, when voltage lower than the discharge start voltage Vth is applied to the charging roller 2, more electric current is generated by implanted charging due to a discharge product. Thus, it can be said that the cleanerless image forming apparatus can provide the advantages of the present disclosure more significantly.

According to the aforementioned embodiments, direct current voltage is only applied as charging voltage to the charging roller 2 for image forming. However, vibration voltage superimposing direct current voltage and AC voltage as charging voltage may be applied to the charging roller 2 for image forming. According to the aforementioned embodiments, direct current voltage is only applied as development voltage to the development roller 41 for image forming. However, vibration voltage superimposing direct current voltage and AC voltage may be applied to the development roller 41 for image forming.

According to the aforementioned embodiments, the image forming apparatus 100 applies an intermediate transfer scheme. However, the present disclosure may also be applicable to an image forming apparatus applying a direct transfer scheme. As well known by those skilled in the art, an image forming apparatus based on a direct transfer scheme has a recording material bearing member such as an endless belt configured to bear and convey a recording material P instead of an intermediate transfer member according to the aforementioned embodiments. Then, in the image forming apparatus based on a direct transfer scheme, toner images formed on a plurality of photoconductive drums 1 are directly transferred to a recording material P born and conveyed by a recording material bearing member, in the same manner as that of the primary transfer according to the aforementioned embodiments. Even this type of image forming apparatus may cause a problem because of attachment of a discharge product to a surface of the photoconductive drum 1, like the embodiment. Accordingly, the present disclosure may be applied to such an image forming apparatus to provide the same advantages as those of the aforementioned embodiments.

According to the aforementioned embodiments, the image exposure device 3 is used as an exposing unit configured to form an exposure region on the photoconductive drum 1 in the image smearing detection operation. However, embodiments may use a pre-exposure apparatus. As well known by those skilled in the art, the image forming apparatus 100 may include a static-eliminating unit configured to remove and static-eliminate at least a part of electric charges on the surface of the photoconductive drum 1 downstream and upstream closely to the transfer position and the charged position in the rotation direction of the photoconductive drum 1. As the static-eliminating unit, a pre-exposure apparatus may be provided which irradiates light to the photoconductive drum 1. In such an image forming apparatus, the pre-exposure apparatus can be used to form an exposure region on the photoconductive drum 1, which is similar to those of the aforementioned embodiments.

According to the aforementioned embodiments, the image smearing detection operation and the image smearing suppression operation are executed in the post-rotation process that is a non-image-forming period. However, the present disclosure is not limited thereto. The image smearing detection operation and the image smearing suppression operation can be executed at arbitrary times during a non-image-forming period. In a case where the image smearing suppression operation heats the surface or surrounding of the photoconductive drum 1, for example, the image smearing suppression operation can be executed irrespective of an image forming period and a non-image-forming period. The image smearing detection operation and the image smearing suppression operation are not limited to be continuously executed, but the image smearing suppression operation may be executed at an arbitrary time after execution of the image smearing detection operation is determined.

According to the aforementioned embodiments, the charging rollers 2 are used as abutting members for detecting electric current due to implanted charging. However, the present disclosure is not limited thereto. Any abutting member configured to abut against the photoconductive drum 1 directly or through an intermediate transfer member or a recording material bearing member can be used which has a sufficient conductivity and can apply voltage to the photoconductive drum 1. For example, the abutting member may be a development member such as the development roller 41, a transfer member such as a primary transfer roller 5, or a cleaning member such as the cleaning blade 61. In other words, the abutting member may be the charging roller 2 configured to charge a surface of the photoconductive drum 1, the development roller 41 configured to supply toner to the surface of the photoconductive drum 1, the primary transfer roller 5 configured to transfer an image formed with toner on the surface of the photoconductive drum 1 to a transfer material, or the cleaning blade 61 configured to remove toner from the surface of the photoconductive drum 1.

According to the aforementioned embodiments, the charging roller 2 is a roller-shaped member. However, it may be a belt-shaped member, a pad-shaped member, a brush-shaped member or the like, for example. Also, the primary transfer roller 5 and the cleaning blade 61 may be a pad-shaped member and a brush-shaped member, respectively, for example. The photosensitive member is not limited to the drum-shaped photoconductive drum 1 but may be an endless-belt-shaped photoconductive belt. The intermediate transfer member and the recording material bearing member are not limited to those being an endless-belt shaped but may be drum-shaped by stretching a film across a frame, for example.

The discharge start voltage Vth may vary in accordance with the thickness of the photoconductive layer of the photoconductive drum 1, for example, as described above. Therefore, the value of the direct current voltage lower than the discharge start voltage Vth may be preset to be sufficiently lower than the discharge start voltage Vth in accordance with the operating environment or lifetime of the image forming apparatus 100. Alternatively, a characteristic of the discharge start voltage Vth depending on various factors may be acquired in advance through experiments, for example, and the discharge start voltage Vth may be predicted, and, based on the result, the value of the direct current voltage lower than the discharge start voltage Vth can be changed. In the image forming apparatus 100, a plurality of test voltages may be applied to an abutting member such as the charging roller 2 to acquire a current/voltage characteristic so that the discharge start voltage Vth can be acquired from the characteristic. Typically, at least one direct current voltage lower than the discharge start voltage Vth and at least one direct current voltage greater than the discharge start voltage Vth may be applied, and electric currents fed to the charging power supply when the voltages are applied are measured. Thus, a current/voltage characteristic as illustrated in FIG. 6 can be acquired. For example, schematically, in the current/voltage characteristic of a voltage range greater than the discharge start voltage Vth, a discharge start voltage Vth can be acquired from a flexion point of the resulting characteristic corresponding to the voltage value in a case where the electric current value is equal to 0 μA. The operation for acquiring a discharge start voltage Vth can be performed at a predetermined time during a non-image-forming period. The predetermined time can be a time when at least one environment condition such as a temperature or a humidity ranges by a predetermined amount or more or a time when an index value mutual related to the used amount of the photoconductive drum 1 exceeds a predetermined threshold value. The index value mutual related to the used amount of the photoconductive drum 1 may be any arbitrary value such as the number of rotations, a rotating time, a time period for performing a charging process, or the number of sheets of image forming.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2017-173471 filed Sep. 8, 2017, which is hereby incorporated by reference herein in its entirety.

What is claimed is:

1. An image forming apparatus comprising:

a first image forming unit including a rotatable first image bearing member, a first charging member configured to come into contact with the first image bearing member to form a first charging portion and to charge a surface of the first image bearing member at the first charging portion, and a first development member configured to supply a developer to the surface of the first image bearing member;

a second image forming unit including a rotatable second image bearing member, a second charging member configured to come into contact with the second image bearing member to form a second charging portion and to charge a surface of the second image bearing member at the second charging portion, and a second development member configured to supply a developer to the surface of the second image bearing member;

an exposing unit configured to expose the surface of the first image bearing member charged by the first charging member and the surface of the second image bearing member charged by the second charging member;

a charging voltage applying unit configured to apply charging voltage to the first charging member and the second charging member;

a detecting unit configured to detect a first current value of electric current flowing from the first charging member to the first image bearing member at the first charging portion and a second current value of electric current flowing from the second charging member to the second image bearing member at the second charging portion while the charging voltage is applied; and a control unit configured to control the charging voltage applying unit and the exposing unit, wherein in a case where the detecting unit detects the first current value and the second current value, the control unit is configured to perform control so that timing when the surface of the first image bearing member exposed by the exposing unit reaches the first charging portion is different from timing when the surface of the second image bearing member exposed by the exposing unit reaches the second charging portion while the charging voltage applying unit applies the charging voltage having an absolute value smaller than an absolute value of discharge start voltage.

2. The image forming apparatus according to claim 1, wherein the charging voltage applying unit has separate power supplies each configured to apply voltage to corresponding one of the first charging member and the second charging member.

3. The image forming apparatus according to claim 1, wherein the charging voltage applying unit has a common power supply configured to apply voltage to the first charging member and the second charging member.

4. The image forming apparatus according to claim 1, wherein in a case where the detecting unit detects the first current value and the second current value, the control unit is configured to control the exposing unit to expose the first image bearing member and the second image bearing member so that an absolute value of a surface potential formed on the first image bearing member and an absolute value of a surface potential formed on the second image bearing member are small after the control unit controls the charging voltage applying unit to apply direct current voltage smaller than the discharge start voltage to the first charging member and the second charging member, while the absolute value of the surface potential of the first image bearing member and the absolute value of the surface potential of the second image bearing member are equal to or smaller than a predetermined value.

5. The image forming apparatus according to claim 4, wherein the predetermined value is equal to substantially 0 V.

6. The image forming apparatus according to claim 1, wherein in a case where the detecting unit detects the first current value and the second current value, the control unit is configured to control the exposing unit to expose the first image bearing member and the second image bearing member so that an absolute value of a surface potential formed on the first image bearing member and an absolute value of a surface potential formed on the second image bearing member are small after the control unit controls the charging voltage applying unit to apply direct current voltage equal to or larger than the discharge start voltage to the first charging member and the second charging member.

7. The image forming apparatus according to claim 1, wherein the control unit is configured to control the first image bearing member and the second image bearing member to execute an operation to reduce an influence of a discharge product attached to surfaces of the first and second image bearing members based on the first current value and the second current value detected by the detecting unit.

8. The image forming apparatus according to claim 7, wherein, in a case where the absolute value of electric current value or voltage value detected by the detecting unit when the surface of the first image bearing member exposed by the exposing unit passes by the first charging portion is equal to or greater than a predetermined threshold value, the control unit causes the first image bearing member to execute the operation, and in a case where the absolute value of the electric current value or voltage value detected by the detecting unit when the surface of the second image bearing member exposed by the exposing unit passes by the second charging portion is equal to or greater than a predetermined threshold value, the control unit causes the second image bearing member to execute the operation.

9. The image forming apparatus according to claim 1, wherein the surface of the first image bearing member exposed by the exposing unit and the surface of the second image bearing member exposed by the exposing unit are formed in an entire region exposable by the exposing unit in a direction substantially orthogonal to a movement direction of the surfaces of the first image bearing member and the second image bearing member.

10. The image forming apparatus according to claim 1, wherein a developer remaining on the surfaces of the first image bearing member and the second image bearing member without being transferred onto a transfer material after images formed with the developer are transferred from the first image bearing member and the second image bearing member to the transfer material is collected by the first development member and the second development member configured to supply the developer to the surfaces of the first image bearing member and the second image bearing member.

11. The image forming apparatus according to claim 10, wherein the developer is a one-component developer.

12. An image forming apparatus comprising:

a first image forming unit including a rotatable first image bearing member, a first charging member configured to come into contact with the first image bearing member to form a first charging portion and to charge a surface of the first image bearing member at the first charging portion, a first development member configured to supply a developer to the surface of the first image bearing member, and a first transfer member configured to transfer an image formed with a developer on a surface of the first image bearing member to a transfer material at a first transfer portion;

a second image forming unit including a rotatable second image bearing member, a second charging member configured to come into contact with the second image bearing member to form a second charging portion and to charge a surface of the second image bearing member at the second charging portion, a second development member configured to supply a developer to the surface of the second image bearing member, and a second transfer member configured to transfer an image formed with a developer on a surface of the second image bearing member to a transfer material at a second transfer portion;

an exposing unit configured to expose the surface of the first image bearing member charged by the first charging member and the surface of the second image bearing member charged by the second charging member;

a transfer voltage applying unit configured to apply transfer voltage to the first transfer member and the second transfer member;

a detecting unit configured to detect a first current value of electric current flowing from the first transfer member to the first image bearing member and a second current value of electric current flowing from the second transfer member to the second image bearing member while the transfer voltage is applied; and a control unit configured to control the transfer voltage applying unit and the exposing unit, wherein in a case where the detecting unit detects the first current value and the second current value, the control unit is configured to perform control so that timing when the surface of the first image bearing member exposed by the exposing unit reaches the first transfer portion is different from timing when the surface of the second image bearing member exposed by the exposing unit reaches the second transfer portion while the transfer voltage applying unit applies the transfer voltage having an absolute value smaller than an absolute value of discharge start voltage.

13. The image forming apparatus according to claim 12, wherein in a case where the detecting unit detects the first current value and the second current value, the control unit is configured to control the exposing unit to expose the first image bearing member and the second image bearing member so that an absolute value of a surface potential formed on the first image bearing member and an absolute value of a surface potential formed on the second image bearing member are small after the control unit controls the transfer voltage applying unit to apply direct current voltage smaller than the discharge start voltage to the first transfer member and the second transfer member, while the absolute value of the surface potential of the first image bearing member and the absolute value of the surface potential of the second image bearing member are equal to or smaller than a predetermined value.

14. The image forming apparatus according to claim 13, wherein the predetermined value is equal to substantially 0 V.

15. The image forming apparatus according to claim 12, in a case where the detecting unit detects the first current value and the second current value, the control unit is configured to control the exposing unit to expose the first image bearing member and the second image bearing member so that an absolute value of a surface potential formed on the first image bearing member and an absolute value of a surface potential formed on the second image bearing member are small after the control unit controls the transfer voltage applying unit to apply direct current voltage equal to or larger than the discharge start voltage to the first transfer member and the second transfer member.

16. The image forming apparatus according to claim 12, the control unit is configured to control the first image bearing member and the second image bearing member to execute an operation to reduce an influence of a discharge product attached to surfaces of the first and second image bearing members based on the first current value and the second current value detected by the detecting unit.

17. The image forming apparatus according to claim 16, wherein, in a case where the absolute value of electric current value or voltage value detected by the detecting unit when the surface of the first image bearing member exposed by the exposing unit passes by the first transfer portion is equal to or greater than a predetermined threshold value, the control unit causes the first image bearing member to execute the operation, and in a case where the absolute value of electric current value or voltage value detected by the detecting unit when the surface of the second image bearing member exposed by the exposing unit passes by the second transfer portion is equal to or greater than a predetermined threshold value, the control unit causes the second image bearing member to execute the operation.

18. The image forming apparatus according to claim 12, wherein the surface of the first image bearing member exposed by the exposing unit and the surface of the second image bearing member exposed by the exposing unit are formed in an entire region exposable by the exposing unit in a direction substantially orthogonal to a movement direction of the surfaces of the first image bearing member and the second image bearing member.

19. The image forming apparatus according to claim 12, wherein a developer remaining on the surfaces of the first image bearing member and the second image bearing member without being transferred onto a transfer material after images formed with the developer are transferred from the first image bearing member and the second image bearing member to the transfer material is collected by the first development member and the second development member configured to supply the developer to the surfaces of the first image bearing member and the second image bearing member.

20. The image forming apparatus according to claim 19, wherein the developer is a one-component developer.

* * * * *